US011473380B2

(12) United States Patent
Mikalsen

(10) Patent No.: US 11,473,380 B2
(45) Date of Patent: Oct. 18, 2022

(54) MUD BUCKET WITH INTEGRAL FLUID STORAGE

(71) Applicant: CANRIG ROBOTIC TECHNOLOGIES AS, Sandnes (NO)

(72) Inventor: Kenneth Mikalsen, Sandnes (NO)

(73) Assignee: CANRIG ROBOTIC TECHNOLOGIES AS, Sandnes (NO)

( * ) Notice: Subject to any disclaimer, the term of this patent is extended or adjusted under 35 U.S.C. 154(b) by 0 days.

(21) Appl. No.: 17/219,683

(22) Filed: Mar. 31, 2021

(65) Prior Publication Data

US 2021/0301606 A1 Sep. 30, 2021

Related U.S. Application Data

(60) Provisional application No. 63/003,170, filed on Mar. 31, 2020.

(51) Int. Cl.
*E21B 21/01* (2006.01)
*E21B 33/08* (2006.01)

(52) U.S. Cl.
CPC ..... *E21B 21/01* (2013.01); *E21B 33/08* (2013.01)

(58) Field of Classification Search
CPC ..... E21B 21/01; E21B 33/08; E21B 21/00; E21B 21/019
See application file for complete search history.

(56) References Cited

U.S. PATENT DOCUMENTS

| | | | | |
|---|---|---|---|---|
| 4,450,905 | A | 5/1984 | Crain | |
| 5,295,536 | A * | 3/1994 | Bode | E21B 21/01 175/84 |
| 6,102,673 | A | 8/2000 | Mott et al. | |
| 7,114,235 | B2 | 10/2006 | Jansch et al. | |
| 7,306,032 | B2 | 12/2007 | Paton | |
| 8,281,867 | B2 * | 10/2012 | Belik | E21B 19/16 166/380 |
| 8,733,435 | B2 * | 5/2014 | Webb | E21B 33/08 166/228 |
| 8,763,684 | B2 | 7/2014 | Pearson | |
| 8,839,853 | B1 | 9/2014 | Angers, Jr. | |
| 8,955,602 | B2 | 2/2015 | Pilgrim | |
| 9,664,002 | B2 * | 5/2017 | Webb | E21B 19/16 |
| 9,982,497 | B2 | 5/2018 | Foley | |
| 10,927,619 | B1 * | 2/2021 | Anthony | E21B 21/01 |

(Continued)

FOREIGN PATENT DOCUMENTS

| | | | |
|---|---|---|---|
| WO | 2020/178568 | A2 | 9/2020 |
| WO | 2020/222860 | A1 | 11/2020 |

*Primary Examiner* — James G Sayre
(74) *Attorney, Agent, or Firm* — Abel Schillinger, LLP

(57) ABSTRACT

A system including a mud bucket with a clam shell enclosure and a storage tank. The clam shell enclosure can have a first portion and a second portion, with the second portion being rotationally coupled to the first portion, where the first portion and the second portion are configured to form a sealed chamber around a joint of a tubular string when the second portion is rotated into engagement with the first portion, where the sealed chamber is configured to receive expelled fluid from the tubular string when the joint is unthreaded, and the storage tank is configured to receive and store the expelled fluid from the sealed chamber while the mud bucket is located at the well center.

20 Claims, 31 Drawing Sheets

(56) References Cited

U.S. PATENT DOCUMENTS

| | | | | |
|---|---|---|---|---|
| 2002/0070029 | A1* | 6/2002 | Miramon | E21B 33/08 166/377 |
| 2003/0146219 | A1 | 8/2003 | Ross | |
| 2018/0230762 | A1* | 8/2018 | Blaine | G01N 33/2823 |
| 2019/0136669 | A1 | 5/2019 | Wiedecke et al. | |

* cited by examiner

MUD BUCKET WITH INTEGRAL FLUID STORAGE

CROSS-REFERENCE TO RELATED APPLICATION(S)

This application claims priority under 35 U.S.C. § 119(e) to U.S. Patent Application No. 63/003,170, entitled "MUD BUCKET WITH INTEGRAL FLUID STORAGE," by Kenneth MIKALSEN, filed Mar. 31, 2020, which application is assigned to the current assignee hereof and incorporated herein by reference in its entirety.

TECHNICAL FIELD

The present invention relates, in general, to the field of drilling and processing of wells. More particularly, present embodiments relate to a system and method for significantly preventing spillage of operational fluids (e.g., drilling mud) when joints of a tubular string are disconnected during subterranean operations.

BACKGROUND

During subterranean operations (e.g., drilling operations) tubular strings may need to be "tripped out" of a wellbore to replace equipment, retrieve sensor data collected downhole, replace tubular segments, inspect equipment, etc. While tripping a segmented tubular string from the wellbore, tubular segments are disconnected from the remaining tubular string and moved from the well center to a storage location (e.g., horizontal or vertical storage). When the tubular segment is disconnected from the tubular string containment systems may be used to capture operational fluids (e.g., drilling mud) contained in the tubular segment being disconnected. The fluids may be captured by a device known as a "mud bucket" and drained off to a remote storage tank. Current mud buckets surround the tubular joint being disconnected to receive the fluids expelled from the tubular segment and a drain hose carries the expelled fluid to a remote collection chamber (mud storage, mud pit, moon pool, etc.). The hose can be coupled to a pump which can pump the expelled fluids to the remote collection chamber. Improvements in these fluid reclamation and containment systems are continually needed.

SUMMARY

In accordance with an aspect of the disclosure, a system is provided for conducting a subterranean operation, the system including a mud bucket that can include a clam shell enclosure comprising a first portion and a second portion, with the second portion rotationally coupled to the first portion, where the first portion and the second portion are configured to form a sealed chamber around a joint of a tubular string at a well center of a rig when the second portion is rotated into engagement with the first portion, with the sealed chamber being configured to receive expelled fluid from the tubular string when the joint is unthreaded; and a storage tank that is configured to receive and store the expelled fluid from the sealed chamber while the mud bucket is located at the well center.

In accordance with another aspect of the disclosure, a method is provided for conducting a subterranean operation that can include the operations of sealing a mud bucket around a joint of a tubular string extending from a drill floor; unthreading the joint; capturing fluid expelled from the tubular string in a sealed chamber of the mud bucket as the joint is being unthreaded; and storing the fluid in a storage tank of the mud bucket.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present), and B is false (or not present), A is false (or not present), and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1:
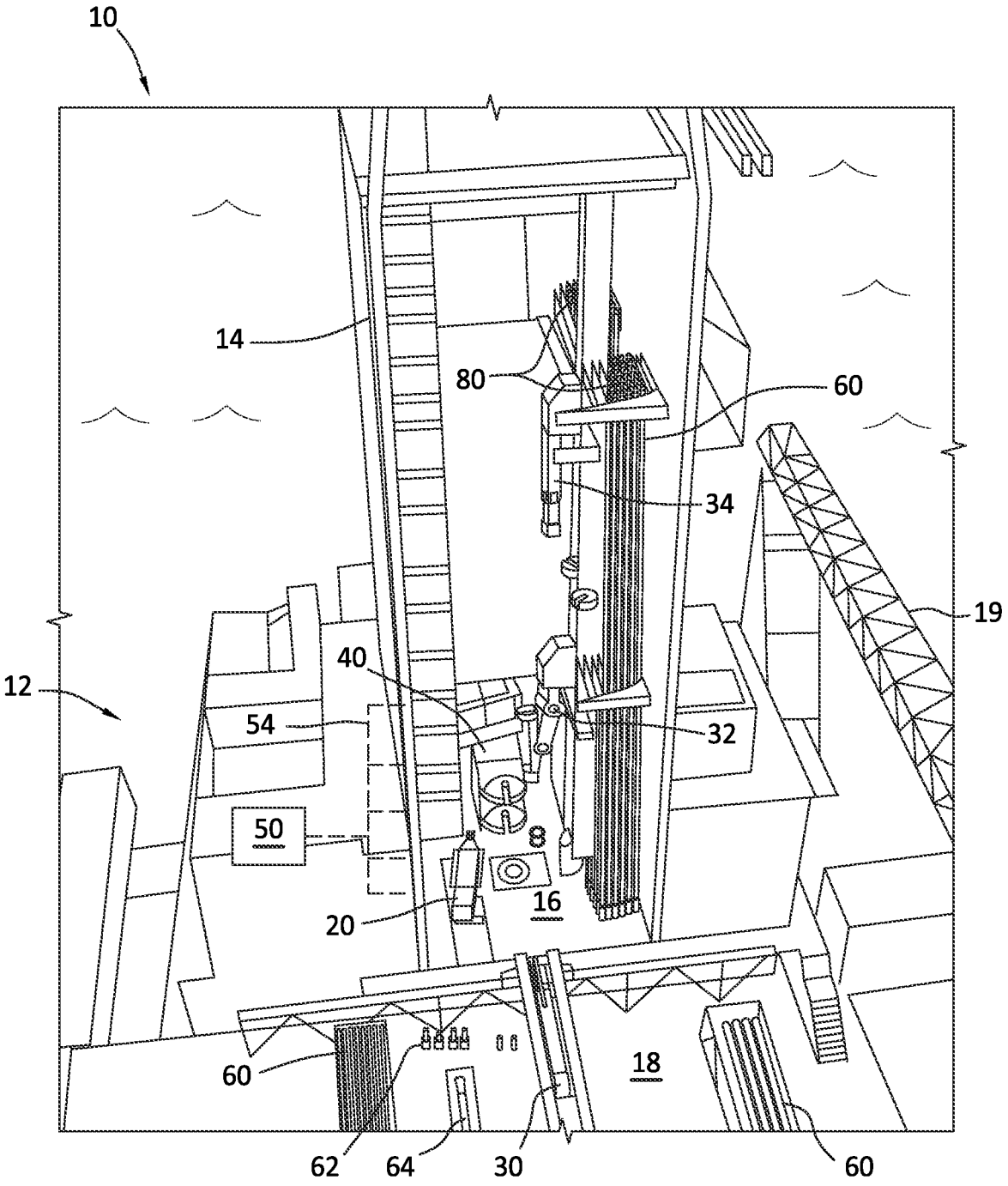
FIG. 1 is a representative view of a rig that can be used to perform subterranean operations, in accordance with certain embodiments.

FIG. 1 is a representative view of a rig 10 that can be used to perform subterranean operations. The rig 10 is shown as an offshore rig, but it should be understood that the principles of this disclosure are equally applicable to onshore rigs as well. The example rig 10 can include a platform 12 with a derrick 14 extending above the platform 12 from the rig floor 16. The platform 12 and derrick 14 provide the general super structure of the rig 10 from which the rig equipment is supported. The rig 10 can include a horizontal storage area 18, pipe handlers 30, 32, 34, a drill floor robot 20, an iron roughneck 40, a crane 19, and fingerboards 80. The equipment on the rig 10, can be communicatively coupled to a rig controller 50 via a network 54, with the network 54 being wired or wirelessly connected to the equipment.

Some of the equipment that can be used during subterranean operations is shown in the horizontal storage area 18 and the fingerboards 80, such as the tubulars 60, the tools 62, and the bottom hole assembly (BHA) 64. The tubulars 60 can include drilling tubular segments, casing tubular segments, and tubular stands that are made up of multiple tubular segments. The tools 62 can include centralizers, subs, slips, adapters, etc. The BHA 64 can include drill collars, instrumentation, and a drill bit.

Figure 2:
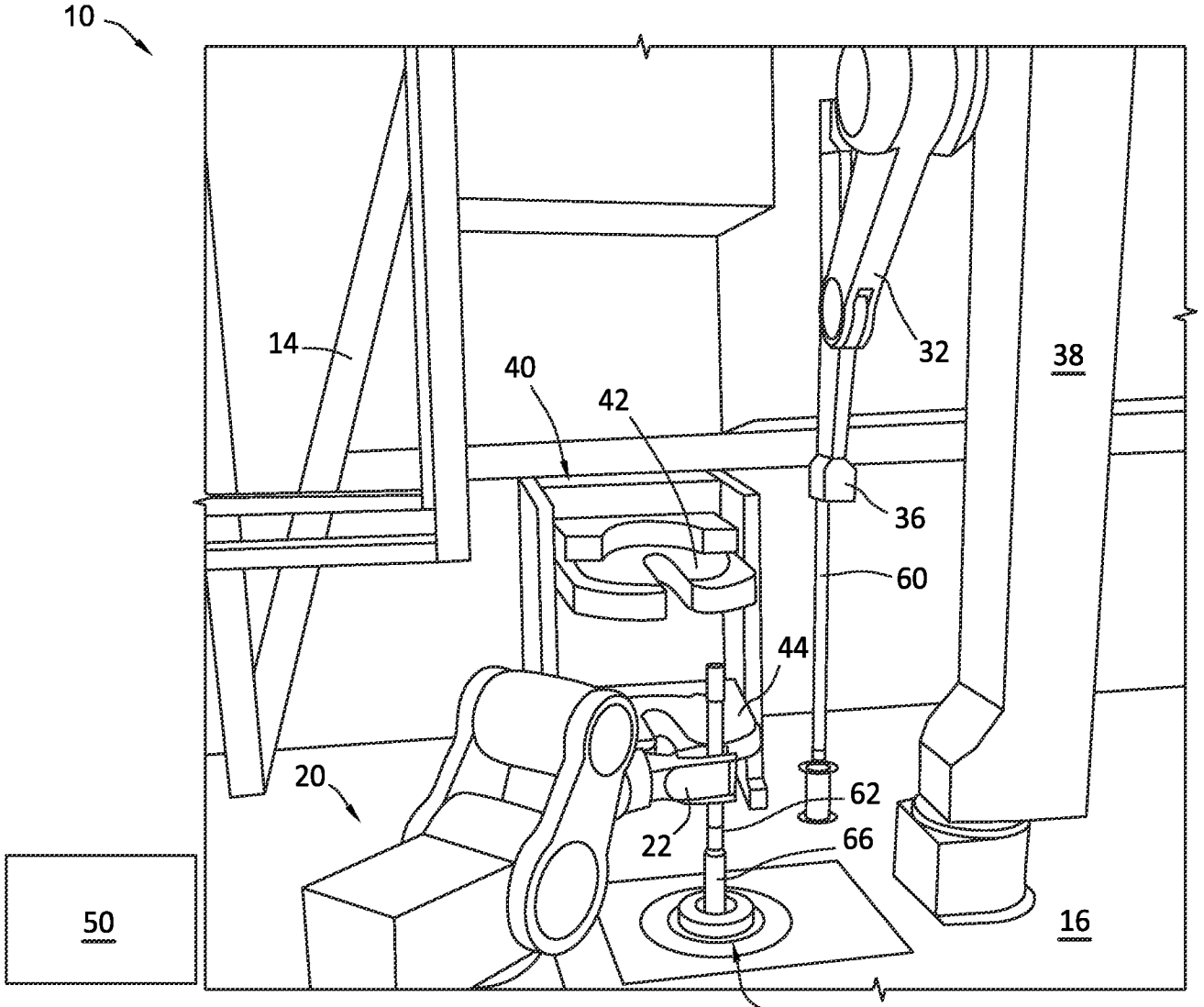
FIG. 2 is representative perspective view of robots that can be used on a drill floor of a rig during subterranean operations, in accordance with certain embodiments.

FIG. 2 is representative perspective view of some robots that can be used on a drill floor 16 of a rig 10 during subterranean operations. FIG. 2 shows a drill floor robot 20 gripping a tool 62 at the top end of the tubular string 66. The gripper 22 can engage the tool 62 and spin it off the top of the tubular string 66 in preparation for installing a tubular 60 to the end of the tubular string 66. The pipe handler 32 can engage a tubular 60 with the grippers 36 and move the tubular 60 from a storage location or the pipe handler 30 to a well center 82 where the pipe handler 32 can thread the tubular 60 onto the tubular string 66. The iron roughneck 40 can then torque the joint via torque wrench 42 and backup tong 44.

When tripping the tubular string 66 from the wellbore, the iron roughneck 40 can be used to break lose the joint via the wrenches 42, 44. The drill floor robot 20 (or other transport means, such as a mobile cart, robotic arm attached to drill floor 16, etc.) can also be used to move a mud bucket 100 between a storage location and a deployed location. For example, the gripper 22 of the drill floor robot 20 can be removed and the drill floor robot 20 connected, via tool interface, to a mud bucket 100 for collecting expelled fluid when a tubular joint is disconnected.

Figure 3:
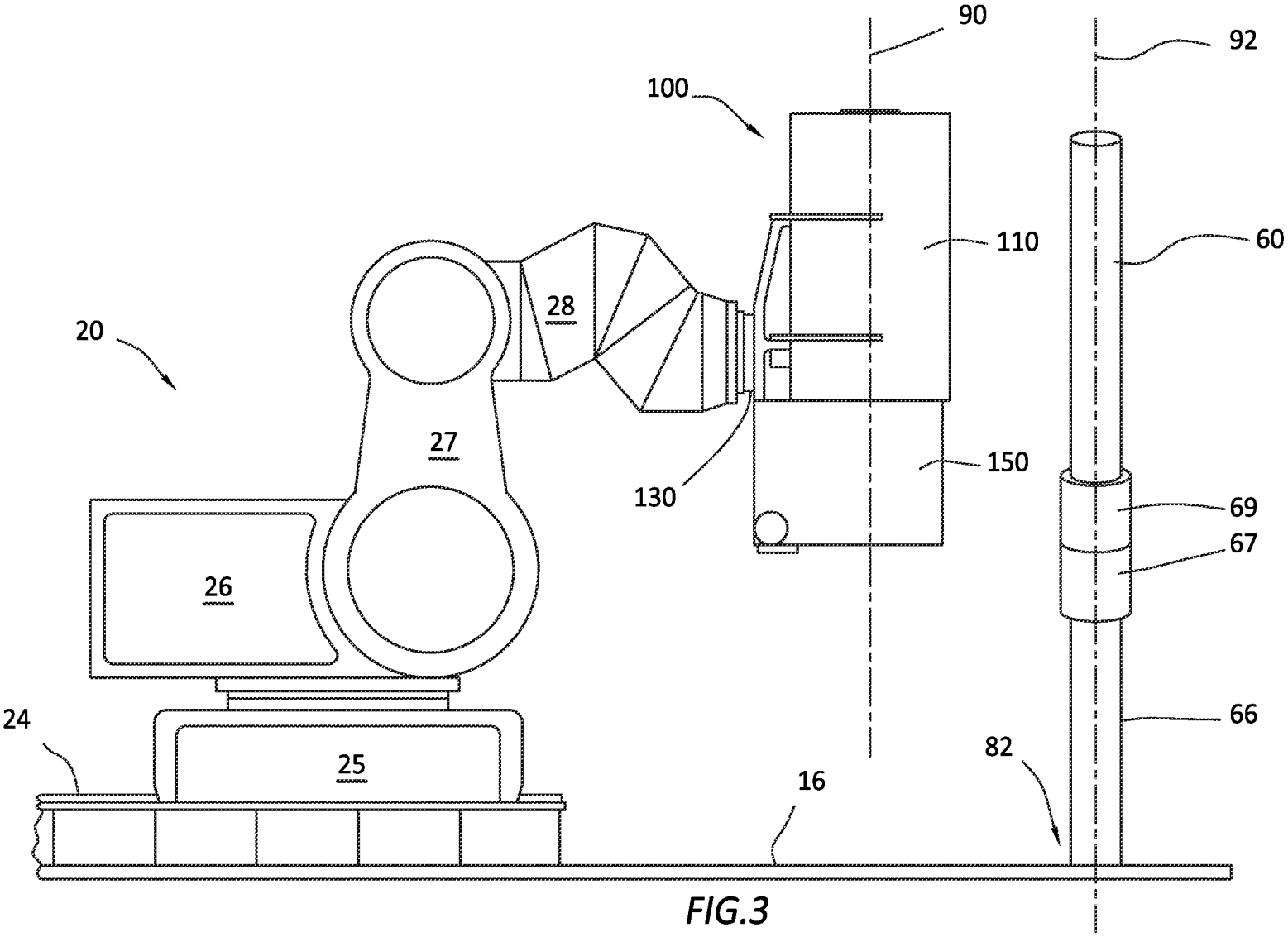
FIG. 3 is a representative side view of a drill floor robot carrying a mud bucket toward a tubular string, in accordance with certain embodiments.

FIG. 3 is a representative side view of a drill floor robot 20 carrying a mud bucket 100 toward a tubular string 66. This example shows a drill floor robot 20 that includes a support platform 24 mounted on a drill floor 16, with a base 25 that can move along the platform 24. A body 26 of the drill floor robot 20 can include control for positioning on the platform 24 and the positioning of the robotic arms 27 and 28. The robotic arm 27 is pivotably connected to the base 26 and to the robotic arm 28. The robotic arm 28 can be a multiple segment arm that provides for a wide range of motion. The robotic arm 28 can be coupled to the mud bucket 100 via a tool interface 130.

The mud bucket 100 can include a clam shell enclosure 110 and a storage tank 150 integrally connected to the clam shell enclosure 110. The clam shell enclosure 110 can have a central longitudinal axis 90 that extends through the storage tank 150. The clam shell enclosure 110 can be configured to seal around a joint in the tubular string 66. When the tubular string 66 is being tripped out, the tubular string 66 can be pulled out of the wellbore at the well center 82 enough to present a joint connection between the pin end 69 of the tubular 60 and the box end 67 of the top end of the tubular string 66. The tubular string 66 can have a longitudinal axis 92 that extends through the tubular 60 and into the tubular string 66.

Figure 4A:
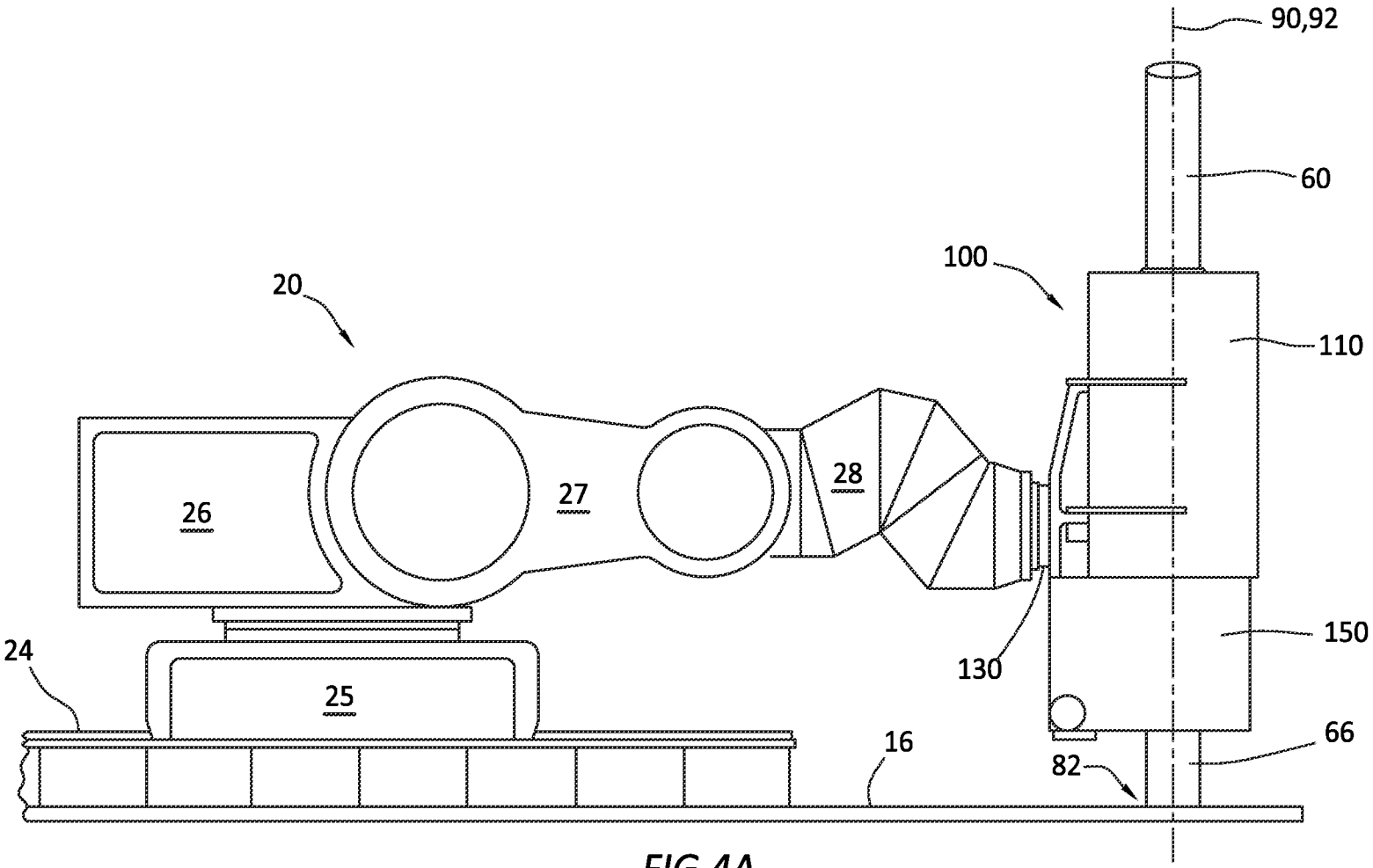
FIG. 4A is a representative side view of a drill floor robot carrying a mud bucket and engaging a tubular string at a joint, in accordance with certain embodiments.

FIG. 4A is a representative side view of a drill floor robot 20 carrying a mud bucket 100 that is sealed around the joint in the tubular string 66. The drill floor robot 20 can manipulate the mud bucket 100 such that the longitudinal axis of the clam shell enclosure 110 and the longitudinal axis 92 of the tubular 60 are aligned (or at least substantially parallel) with each other. This alignment of the two axes 90, 92 can occur when the clam shell enclosure 110 is in an open position allowing the tubular string 66 to enter through a side of the mud bucket 100. Once the axes 90, 92 are aligned (or substantially aligned), the clam shell enclosure 110 can be actuated to close around the tubular string 66, thereby sealing the clam shell enclosure 110 above and below the joint of the tubular string 66. With the clam shell enclosure 110 sealed around the tubular string 66, the tubular 60 can be unthreaded (e.g., via a pipe handler, top drive, spinner, etc.) from the tubular string 66 allowing operational fluid (e.g., drilling mud, water, production fluid, treatment fluid, etc.) contained in the tubular 60 to be released into the clam shell enclosure 110 and collected in the storage tank 150. The storage tank 150 may not include a hose for draining the fluid from the storage tank 150 into a collection chamber positioned away from the well center 82.

The storage tank 150 includes sufficient capacity to receive all the operational fluid expelled from the tubular 60 (which is being disconnected from the tubular string 66) and store the expelled fluid in the storage tank 150 until the mud bucket 100 is removed from the well center 82. When the mud bucket 100 is transported away from well center 82 to a remote location (such as at an inlet to a collection chamber), the outlets of the storage tank 150 can allow the expelled fluid contained in the storage tank 150 to be released into the collection chamber to substantially empty the storage tank 150 in preparation for the next time a tubular 60 is disconnected from the tubular string 66. When substantially emptied, the mud bucket 100 is again ready to repeat the process to capture the expelled operational fluid from the next tubular 60 when it is disconnected from the tubular string 66. This process can continue until all desired tubulars 60 are removed from the tubular string 66.

Figure 4B:
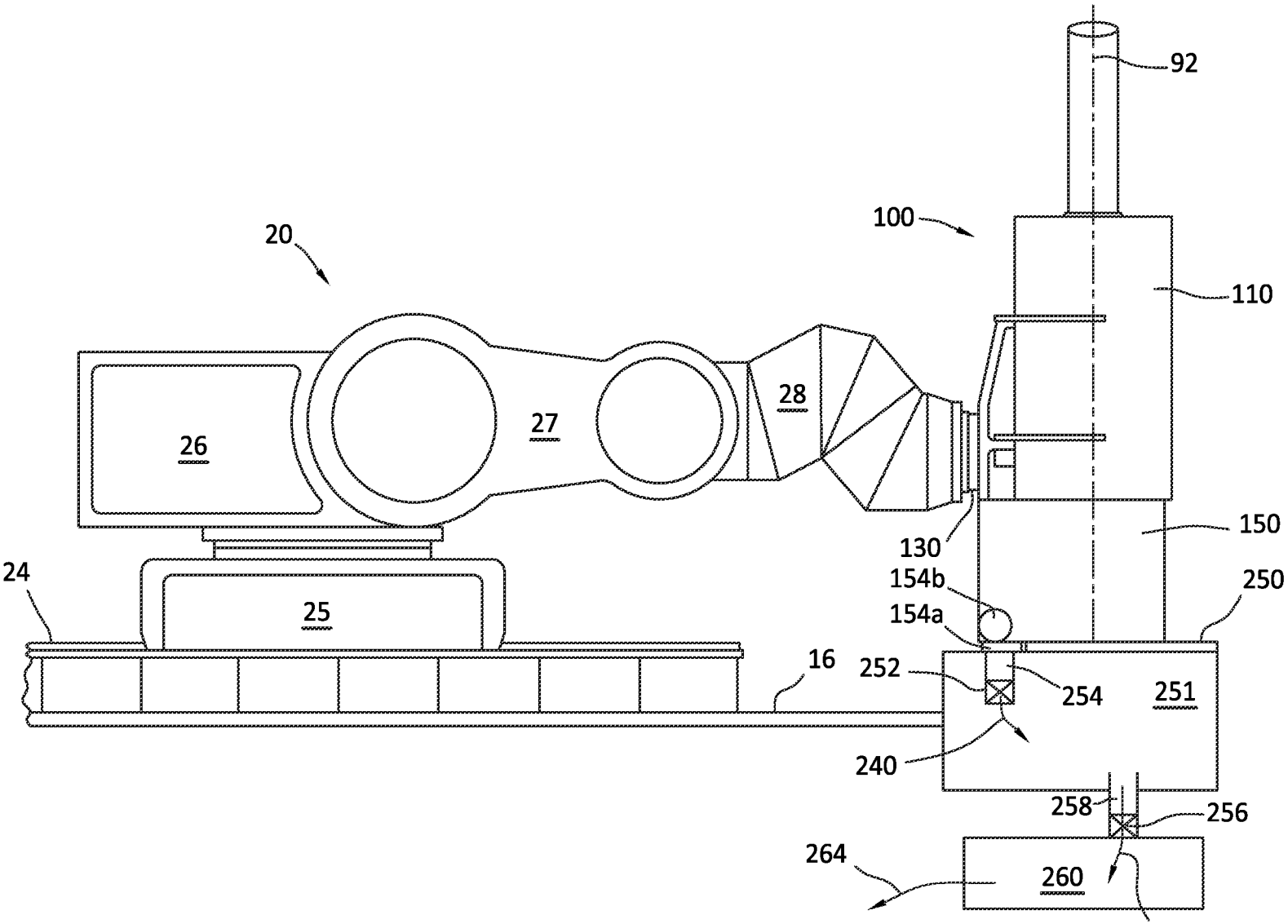
FIG. 4B is a representative functional diagram of a drill floor robot carrying a mud bucket and engaging a docking station, in accordance with certain embodiments.

FIG. 4B is a representative functional diagram of a drill floor robot 20 carrying a mud bucket 100 and engaging a docking station 250 after the mud bucket 100 has captured the expelled fluid from the tubular 60 when the joint of the tubular string 66 was unthreaded. As seen in FIG. 4A, the mud bucket 100 is sealed around a joint of the tubular string 66. When the tubular 60 is unthreaded from the tubular string 66, fluid contained in the tubular 60 can be expelled into the sealed chamber 200 of the clam shell enclosure 110. The expelled fluid 240, as explained in more detail below, can be collected from the sealed chamber 200 and held in the storage tank 150 until the mud bucket 100 is moved away from the well center 82 (and the tubular string 66) and engaged with the docking station 250. The clam shell enclosure 110 can be open or closed when the mud bucket 100 is engaged with the docking station 250. However, it may be preferred to have the clam shell enclosure 110 closed to reduce necessary clearances when moving the mud bucket 100 across the drill floor 16.

The docking station 250 can include an inlet 254 that can engage an outlet 154*a* of the storage tank 150 when the mud bucket 100 engages the docking station 250. Engaging the inlet 254 to the outlet 154*a* can actuate a valve in the storage tank 150 and cause the expelled fluid 240 contained in the storage tank 150 to be released (or discharged) into the docking station 250 chamber 251. A one-way valve 252 (e.g., a flapper valve) can be coupled to the inlet 254 and allow the expelled fluid 240 to enter the chamber 251, but prevent fluid (e.g., liquid or gas) from the chamber 251 from flowing back into the storage tank 150 or into the atmosphere when the mud bucket 100 is not engaged with the docking station 250. This can prevent unintended escape of fluid from a collection chamber 260 (e.g., a mud pit).

The docking station 250 can couple to an inlet 258 of a collection chamber 260 for flowing the expelled fluid 240 from the chamber 251 into the collection chamber 260 as collection fluid 262. A valve 256 can be coupled to the inlet 258 to allow fluid to flow from the chamber 251 into the collection chamber 260 as collection fluid 262. The valve 256 can also be a one-way valve allowing flow in one direction (i.e., fluid 262) and preventing flow through the valve 256 in an opposite direction. However, it should be understood that the docking station 250 may not include a chamber 251, where the expelled fluid 240 that flows through the inlet 254 and through the one-way valve 252 flows directly (howbeit possibly through some conduit) into the collection chamber 260 (e.g., mud pit). The fluid in the collection chamber 260 can then be used to resupply operational fluid 264 to the rig system. The side outlet 154*b* of the storage tank 150 can be connected to a hose through which the expelled fluid can be discharged from the storage tank 150. For example, when the mud bucket 100 cannot be transported (e.g., via the drill floor robot 20) to the docking station 250, then the side outlet 154*b* can be used to for draining the expelled fluid from the storage tank 150 in preparation for maintenance operations.

Figure 5:
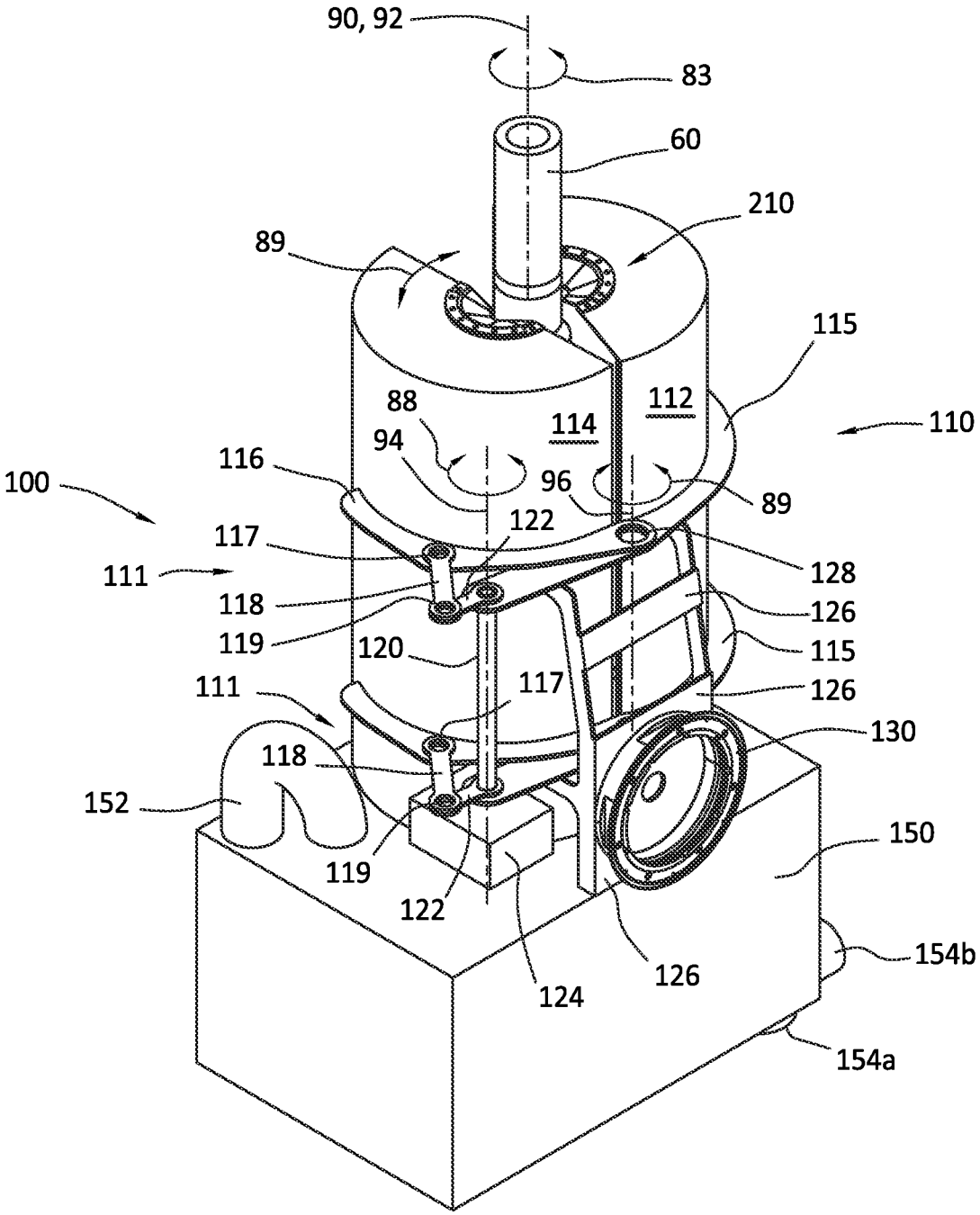
FIG. 5 is a representative perspective rear view of a mud bucket, in accordance with certain embodiments.

FIG. 5 is a representative perspective rear view of the mud bucket 100, according to certain embodiments. The clam shell enclosure 110 can include a stationary portion 112 that can be rotationally fixed to the storage tank 150 and does not move relative to the storage tank 150, and a portion 114 that is rotationally attached to the stationary portion 112 and can be rotated (arrows 89) about axis 96 between open and closed positions. FIG. 5 shows the clam shell enclosure 110 in an open position with the portion 114 rotated away from the portion 112 to allow a tubular 60 to enter through a side of the clam shell enclosure 110. With the longitudinal axis 92 of the tubular 60 (and tubular string 66) substantially aligned with the longitudinal axis 90 of the clam shell enclosure 110, the clam shell enclosure 110 can be closed around the tubular 60 (or tubular string 66) to form a sealed chamber 200 within which can be positioned the joint of the tubular string 66 that is prepared for disconnecting.

As used herein, a "sealed chamber" refers to a chamber that may be in pressure communication with an environment external to the clam shell enclosure 110 and can be in fluid communication with the external environment at some points along the perimeter seal between the portions 112, 114. Therefore, a "sealed chamber" refers to a chamber that substantially prevents spillage of fluid at well center 82 when the tubular 60 is disconnected from the tubular string 66. For example, a top seal assembly 210 may only need to provide a splash guard for containing the expelled fluid within the clam shell enclosure 110, and not a pressure seal. Further stated, if the clam shell enclosure 110 were rotated upside down, the expelled fluid within the clam shell enclosure 110 might leak out through the seal assembly 210, but when the clam shell enclosure 110 is upright and the seal assembly 210 is positioned at the top of the clam shell enclosure 110, most (if not all) of the expelled fluid can be successfully contained within the clam shell enclosure 110 until the expelled fluid is released into an inlet of a collection chamber 251 or 260 (e.g., a mud pit), the inlet being spaced away from the well center 82. With that said, the bottom seal assembly 220 (not shown, see FIG. 9C) may require a more robust seal around the tubular string 66 to prevent the expelled fluid contained within the clam shell enclosure 110 from being forced past the bottom seal assembly 220 when the fluid from the tubular 60 is drained into the storage tank 150. Therefore, the "sealed chamber" can include a top seal that can be more of a splash guard and a bottom seal that can form a tight seal with the tubular string 66 and substantially prevent leakage of the fluid through the seal or between the seal and the tubular string 66 when the clam shell enclosure 110 is engaged with the tubular string 66.

The portion 112 can have one or more structural supports 115 arranged on a perimeter of the portion 112 which can provide support for a rotational connection to one or more supports 116 on a perimeter of the portion 114. Each of the supports 115 can be rotationally coupled to a respective support 116 at a pivot 128. It should be understood that the supports 115, 116 are not required, since the portions 112, 114 can be configured to support a pivot 128 connection between the portions 112, 114. The pivot 128 can be formed in the portions 112, 114 to allow the portion 114 to be rotated relative to the portion 112.

In this embodiment, the portions 112, 114 are rotationally connected at pivots 128 which are positioned at a location in the supports 115, 116. Linkage assemblies 111 can be used to couple the supports 115, 116 together at respective points in the supports 115, 116 that are spaced away from the pivots 128. Each linkage assembly 111 can include links 118 and 122. The link 118 can be rotationally attached at one end to the link 122 at pivot 119 and rotationally attached at an opposite end to the support 116 at pivot 117. The link 122 can be rotationally attached at one end to the link 118 at pivot 119 and fixedly attached at an opposite end to a drive shaft 120. The drive shaft 120 can be rotationally attached to the supports 115 and driven by an actuator 124. The actuator 124 can comprise a worm gearbox that can provide a self-locking mechanism when the portion 114 is in the closed position.

As the drive shaft 120 is rotated by the actuator 124 in one direction (arrows 88 about axis 94), the links 122 can move toward the portion 114 which moves, via the link 118, toward a closed position. As the drive shaft is rotated by the actuator 124 in an opposite direction (arrows 88 about axis 94), the links 122 can move away from the portion 114 which moves, via the link 118, toward an open position. The actuator 124 can be coupled to a tool interface 130 that can receive rotational drive from an external piece of equipment (e.g., drill floor robot 20, mobile cart, etc.) and transfer the rotational drive from the tool interface 130 to the actuator 124, thereby rotating the drive shaft 120 to actuate the portion 114 between closed and open positions. A support 126 may be included in the mud bucket 100 assembly to provide additional support between the tool interface 130 and the mud bucket 100. It should be understood that any other suitable means for actuating the portion 114 between closed and open positions can be used.

It is not a requirement that the portion 114 be actuated between closed and open positions by the rotational drive assembly described in this embodiment. The tool interface 130 should at least be configured to translate an applied force at the tool interface 130 to a rotational force at the actuator to actuate the portion 114 toward a closed or open position. The time needed to open or close the clam shell enclosure 110 can be less than 10 seconds, less than 9 seconds, less than 8 seconds, less than 7 seconds, less than 6 seconds, less than 5 seconds, less than 4 seconds, less than 3 seconds, or less than 2 seconds. A closing force applied to the portion 114 in the closed position should be greater that a hydrostatic pressure of the fluid contained in the sealed chamber 200 plus the force needed to sufficiently compress the seals between the portions 112, 114.

A storage tank 150 can be fixedly attached to the portion 112 and the support 126. The storage tank 150 can include an internal chamber sized to receive the expelled fluid when the tubular 60 is disconnected from the tubular string 66. The storage tank 150 can include an outlet 152 extending from the top of storage tank 150 to maintain pressure equalization between the internal chamber and the external environment. As the expelled fluid is drained into the storage tank 150, air can escape from the outlet 152 to prevent pressurizing the internal chamber. The storage tank 150 can include outlets 154*a*, 154*b* to drain the internal chamber when the mud bucket 100 is moved away from the well center 82.

Figure 6:
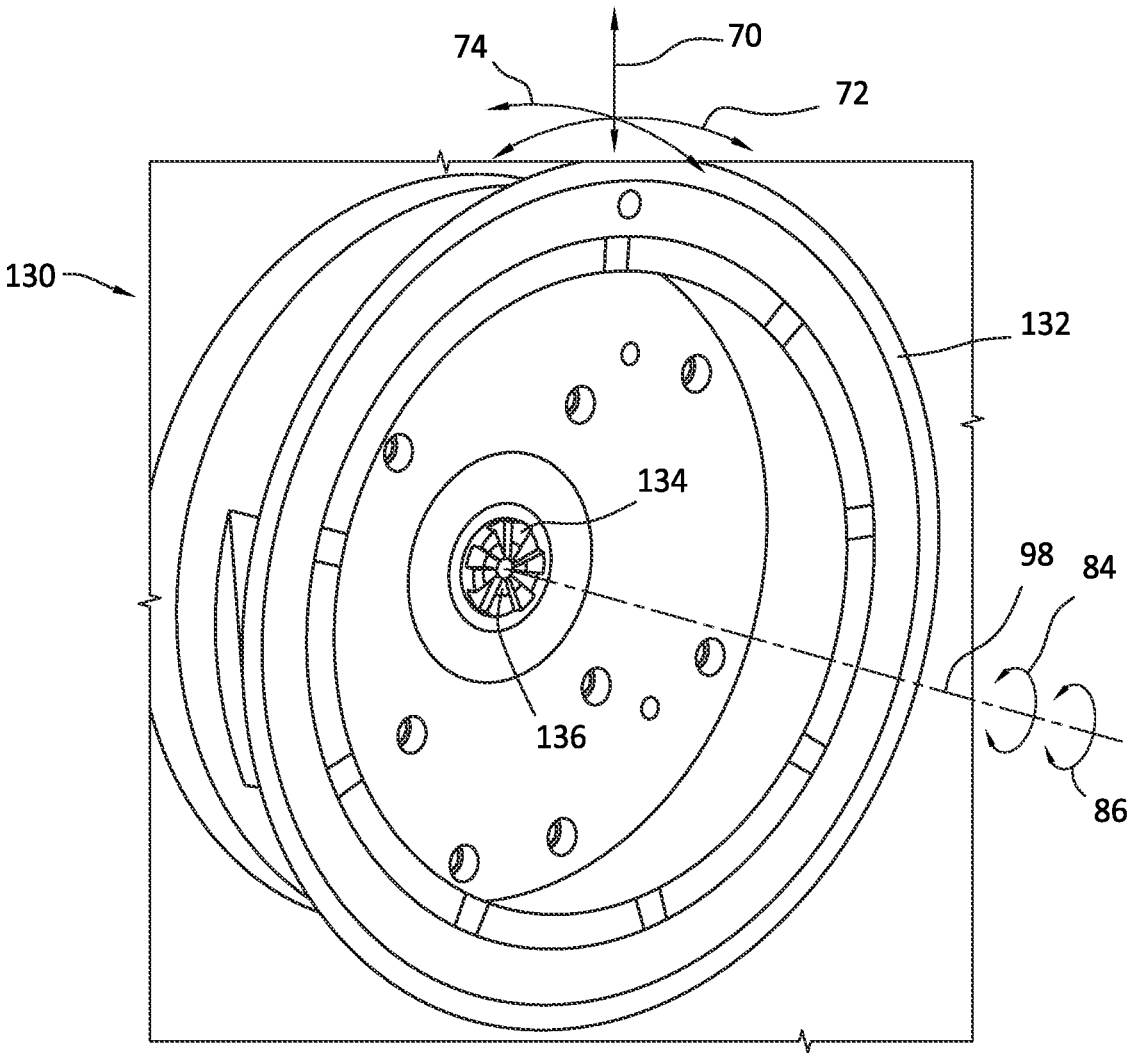
FIG. 6 is a representative perspective view of a tool interface of a mud bucket, in accordance with certain embodiments.

FIG. 6 is a representative perspective view of the tool interface 130 of the mud bucket 100, according to certain embodiments. A conveyance (e.g., drill floor robot, mobile cart, robotic arm attached to drill floor, etc.) can engage the tool interface 130 to move the mud bucket 100 to and away from the well center 82. In this disclosure, the drill floor robot 20 may be used in the description as an example of the conveyance to describe the interaction between the conveyance and the mud bucket 100. However, it should be understood that it is not a requirement that the drill floor robot 20 described in this disclosure be the only conveyance means suitable for conveying the mud bucket 100 about the drill floor 16. For example, a mobile cart with a complimentary tool interface can engage the mud bucket 100 to convey it toward and away from the well center 82. Additionally, a robotic arm rotationally attached to a drill floor 16 can be used to manipulate the mud bucket 100 around the drill floor 16.

This tool interface 130 can be any shape and configuration to engage the conveyance. However, at least one exemplary tool interface 130 is described in this disclosure. Referring to FIG. 6, the tool interface 130 can include a tool engagement structure 132 that can be engaged by a complimentarily configured conveyance interface. The tool interface 130 can receive rotational force (or torque) from the conveyance at either or both of the drive gears 134, 136. These drive gears 134, 136 can be rotated about axis 98 independently of each other (arrows 84 and 86) and can be rotated in opposite directions if desired. Once the tool interface 130 is engaged with the conveyance, then the conveyance can manipulate the mud bucket 100 via the tool interface 130 through multiple axes of movement. For example, the conveyance can tilt the mud bucket 100 forward and backward (arrows 74), rotate the mud bucket 100 left and right (arrows 72), and move the mud bucket 100 up and down (arrows 70). These movements can be used to substantially align the longitudinal axis 90 of the clam shell enclosure 110 with the longitudinal axis 92 of the tubular string 66 and with the joint to be disconnected. Once engaged with the tool interface 130, the conveyance can move the mud bucket 100 about the drill floor as needed to position the mud bucket 100 around a tubular string 66 at the well center 82, or at a fluid discharge location that is remotely positioned away from the well center 82, or to other desired locations on the rig 10.

Figure 7:
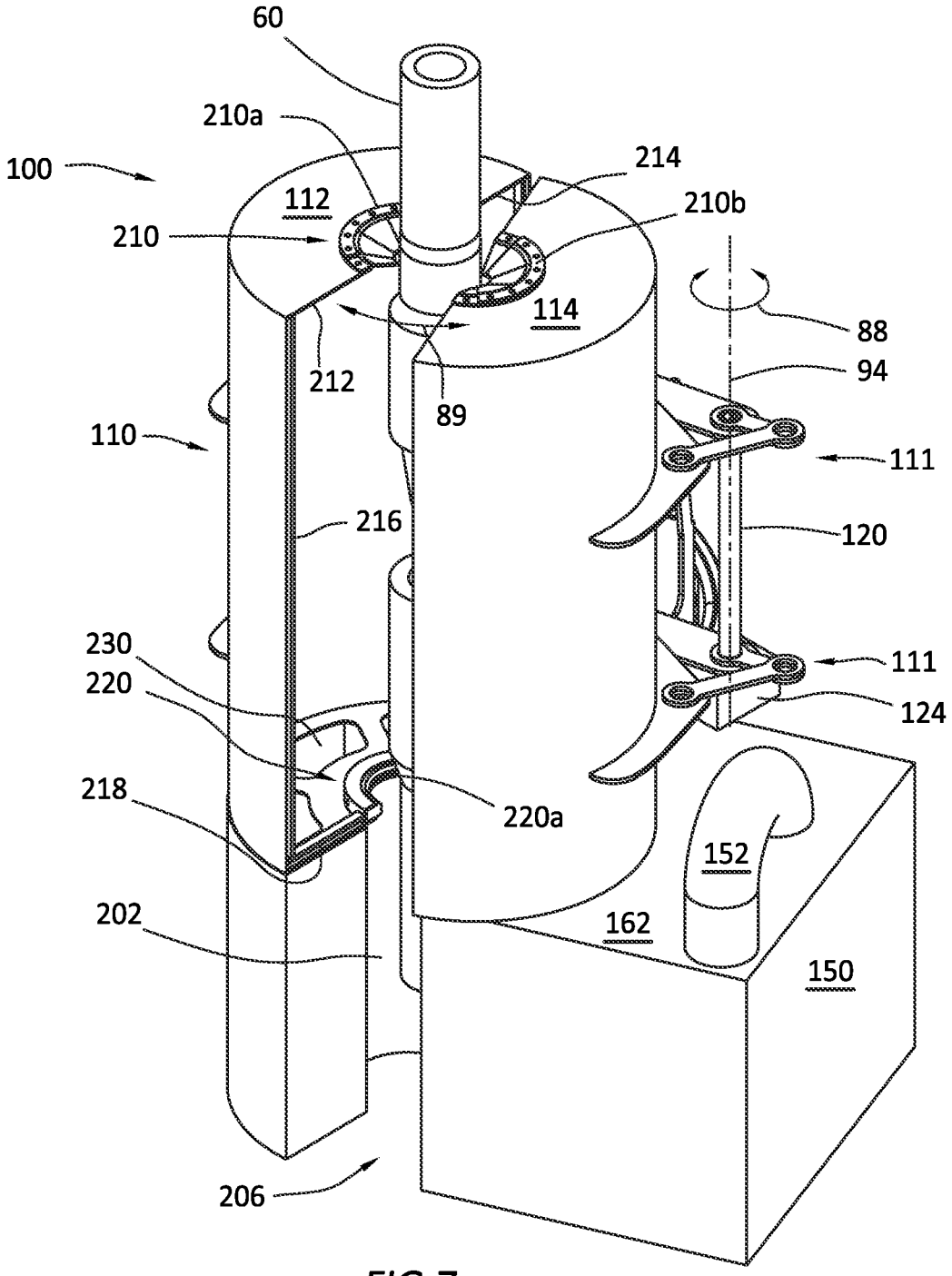
FIG. 7 is a representative perspective front view of a mud bucket, in accordance with certain embodiments.

FIG. 7 is a representative perspective front view of the mud bucket 100, in accordance with certain embodiments. The clam shell enclosure 110 is shown in an open position with a tubular 60 received through the side entrance opening 206 of the clam shell enclosure 110 into the recess or cavity 202 of the clam shell enclosure 110. Seal assemblies 210 and 220 can be used to seal around the tubular string 66 above and below the joint connecting the tubular 60 to the tubular string 66. Seals 212, 214, 216, 218 can be used to seal along a perimeter between the portions 112, 114 when the clam shell enclosure 110 is in the closed position. Openings 230 at the bottom of a chamber 200 can allow the expelled fluid to drain into the storage tank 150 when the clam shell enclosure 110 is closed around the tubular string 66 and the tubular 60 is disconnected from the tubular string 66. The walls of the storage tank 150 can form a recess (or cavity) 202 that provides clearance for the tubular string 66 through the storage tank when the tubular string 66 is aligned with the longitudinal axis 90 of the mud bucket 100.

Figure 8:
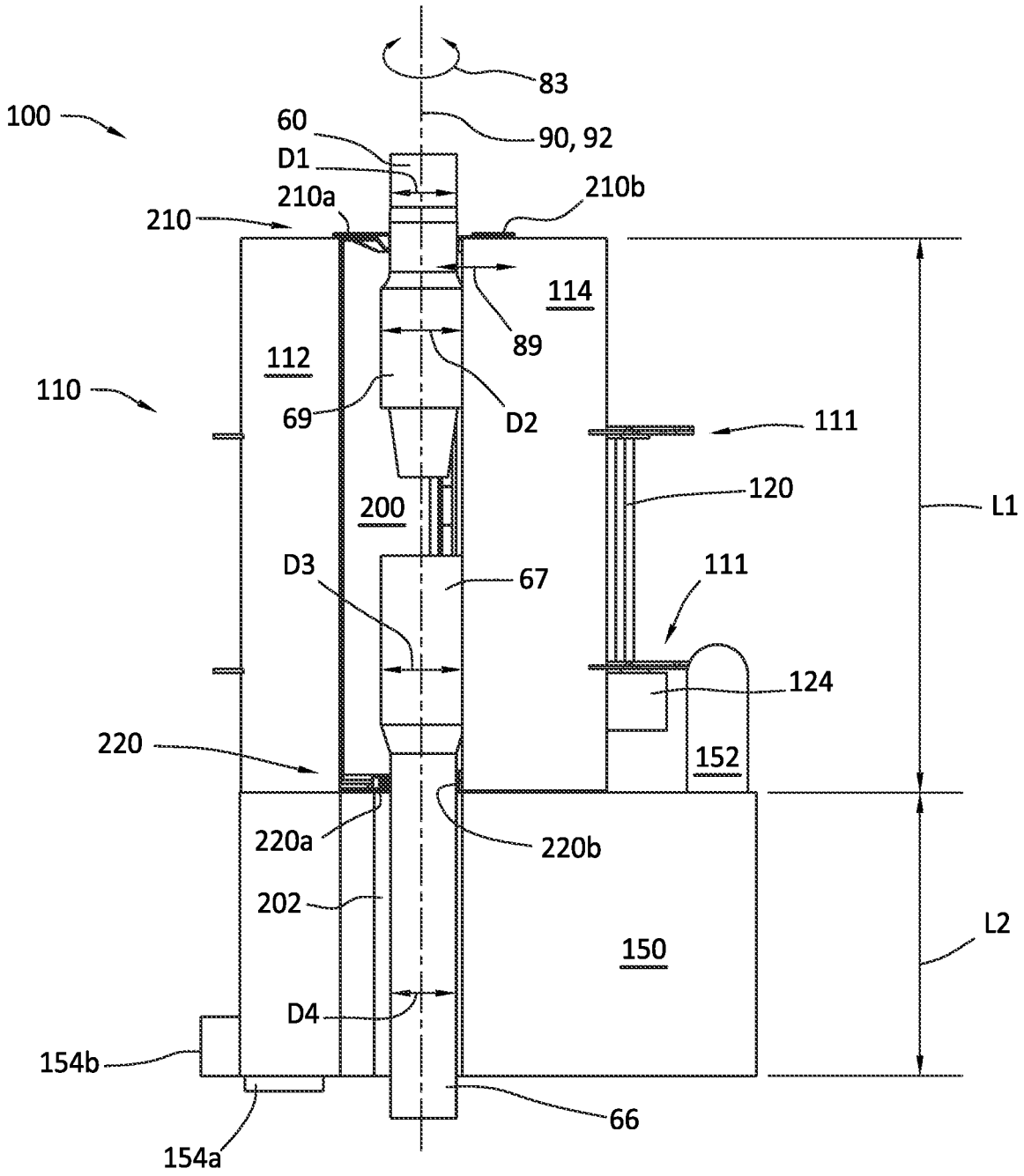
FIG. 8 is a representative front view of a mud bucket, in accordance with certain embodiments.

FIG. 8 is a representative front view of the mud bucket 100 with the tubular 60 and the tubular 66 positioned in the mud bucket 100, in accordance with certain embodiments. The mud bucket 100 is shown in an open position with the expelled fluid already drained into the storage tank 150 via openings 230, and the tubular 60 disconnected from the tubular string 66. The top seal assembly 210 can include two halves 210*a*, 210*b* positioned at the top of the portions 112, 114, respectively. When the clam shell enclosure 110 is closed, the halves 210*a*, 210*b* can form a splash shield around the tubular 60. The diameter D1 is indicated as the outer diameter of the body of the tubular 60. The diameter D2 is indicated as the outer diameter of the pin end 69 of the tubular 60. The diameter D3 is indicated as the outer diameter of the box end 67 of the tubular string 66. The diameter D4 is indicated as the outer diameter of the body of the tubular string 66. It should be noted that the tubular 60 can be extracted from the mud bucket 100 before the clam shell enclosure 110 is opened if the seal assembly 210 is sized to allow the outer diameter D2 of the pin end 69 to move through the seal assembly 210.

When the clam shell enclosure 110 is closed, the halves 220*a*, 220*b* can form a fluid seal around the tubular string 66 below the box end 67. This seal assembly 220 can substantially prevent spillage of the fluid from the bottom of the chamber 200. A pipe handler (e.g., pipe handler 32, top drive, spinner, etc.) can be used to rotate the tubular 60 (arrows 83) about the axis 92 for unthreading the tubular 60 from the tubular string 66. The height L1 of the clam shell enclosure 110 can include the heights of the pin and box ends 69, 67, the longitudinal separation between the pin and box ends 69, 67 when they are unthreaded, a desired longitudinal separation between the pin end 69 and the top of the enclosure 110, and a desired longitudinal separation between the box end 67 and the bottom of the enclosure 110. As way of an example, the length L1 can be 1380 mm. The height L2 of the storage tank 150 may be determined by the volume of fluid that is needed to be stored in the storage tank 150. The volume of fluid to be stored in the storage tank can be multiples (1×, 1.1×, 1.2×, 1.3×, 1.4×, 1.5×, 2.0×, etc.) of the volume of fluid contained in the tubular 60 before it is to be disconnected from the tubular string 66. For example, the tank 150 may need to store up to 750 liters. In this example, the height L2 can be 723 mm.

Figure 9B:
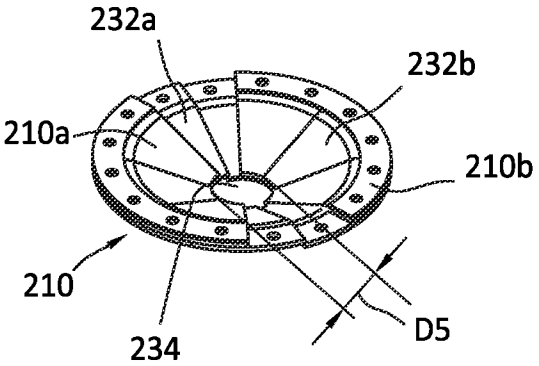
FIG. 9B is a representative perspective view of an upper seal assembly of the mud bucket, in accordance with certain embodiments.
Figure 9C:
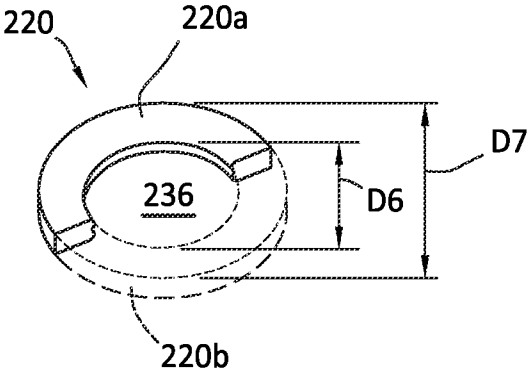
FIG. 9C is a representative perspective view of a lower seal assembly of the mud bucket, in accordance with certain embodiments.
Figure 9A:
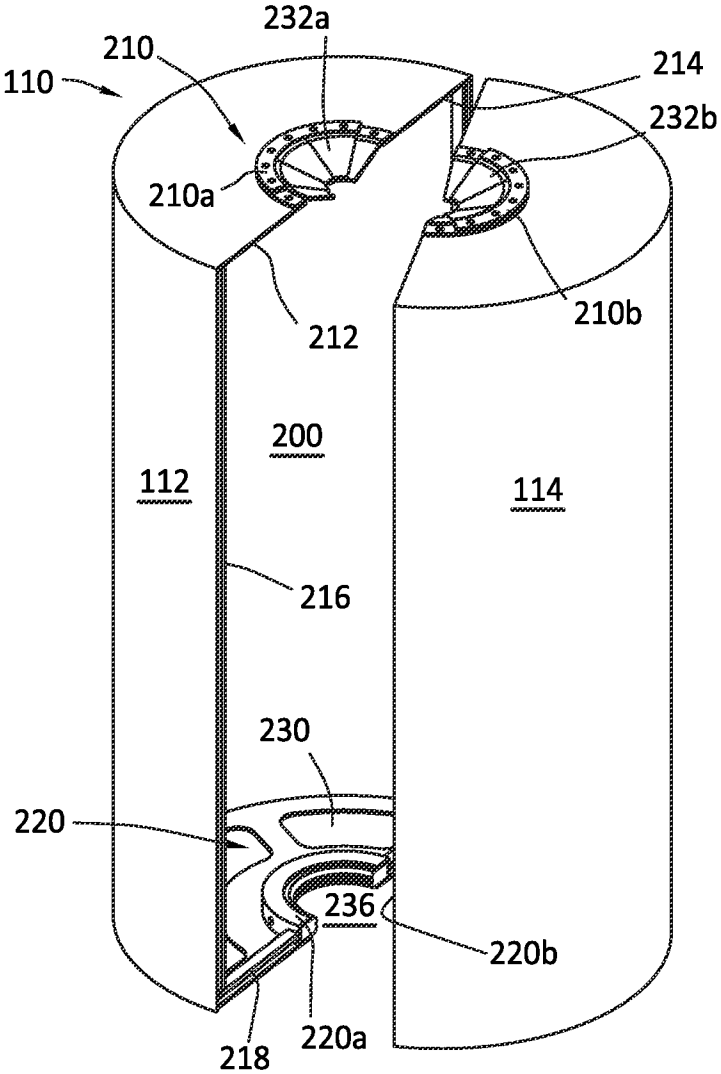
FIG. 9A is a representative perspective front view of a clam shell enclosure of a mud bucket, in accordance with certain embodiments.

FIG. 9A is a representative perspective front view of the clam shell enclosure 110 of the mud bucket 100, according to certain embodiments. The clam shell enclosure 110 is shown in an open position without the storage tank 150 attached. As described above, the seal assemblies 210, 220 are used to seal around the tubular string 66, with the seal assembly 210 used as more of a splash guard as opposed to fluid tight sealing around the tubular string 66. The seals (e.g., 212, 214, 216, 218, including seals not shown) around the perimeter of the interface between the portions 112, 114 can provide fluid tight sealing between the portions 112, 114 at the perimeter seals.

FIG. 9B is a representative perspective view of the upper seal assembly 210 of the mud bucket 100, according to certain embodiments. The two halves 210*a*, 210*b* can form the seal assembly 210 when the portions 112, 114 are in the closed position. The seal assembly 210 can form an opening 234 through the center of the seal assembly 210 with a diameter D5. The diameter D5 can vary to accommodate tubulars 60 of different outer diameters D1 and D2. The seal assembly 210 can include multiple arcuate resilient seal segments 232*a*, 232*b* which may overlap its neighbor (i.e., adjacent segments) to minimize gaps as the segments are flexed to accommodate the tubular 60.

FIG. 9C is a representative perspective view of the lower seal assembly 220 of the mud bucket 100, according to certain embodiments. The two halves 220*a*, 220*b* can form the seal assembly 220 when the portions 112, 114 are in the closed position. The seal assembly 220 can form an opening 236 through the center of the seal assembly 220 with a diameter D6. The diameter D6 can vary as the seal assembly 220 is compressed against the tubular string 66. However, to accommodate various diameters of tubular strings 66, the seal assembly may be replaced with different halves 210*a*, 210*b*. The outer diameter D7 of the seal assembly 220 remains substantially constant, but the inner diameter D6 can vary between different sets of seal halves 220*a*, 220*b* to accommodate tubular strings 66 with varied outer diameters.

Figure 10:
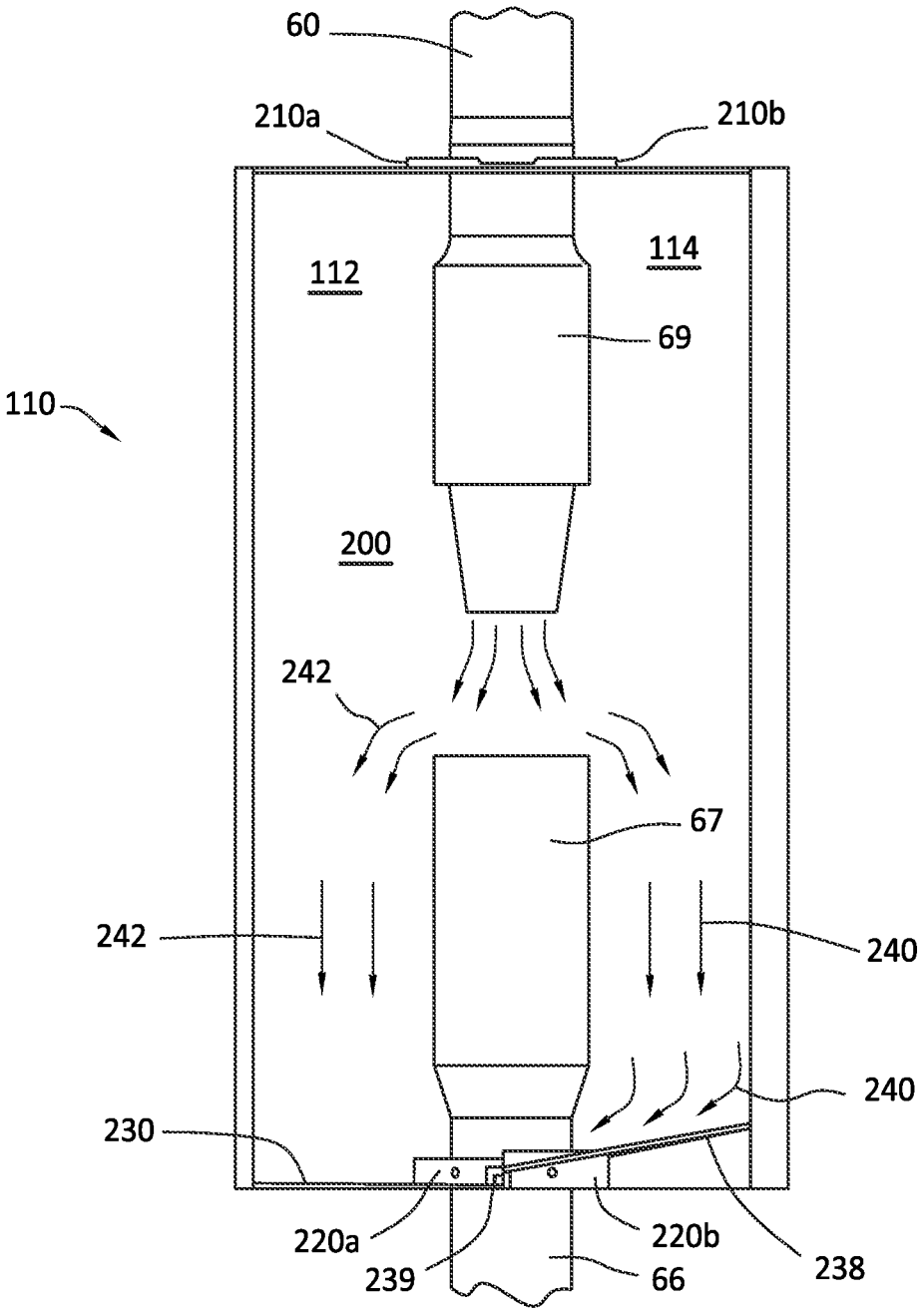
FIG. 10 is a representative partial cross-section view of a clam shell enclosure of a mud bucket, in accordance with certain embodiments.

FIG. 10 is a representative partial cross-section view of the clam shell enclosure 110 of a mud bucket 100, according to certain embodiments. The clam shell enclosure 110 is shown in a closed position without the storage tank 150 attached. The portion 114 has been rotated into engagement with the portion 112, causing the seal assembly 210 to seal around the tubular 60 above the joint and the seal assembly 220 to seal around the tubular string 66 below the joint. These seal assemblies 210, 220 as well as the perimeter seals (e.g., 212, 214, 216, 218) can form a sealed chamber 200 within the clam shell enclosure 110 that can contain and direct expelled fluid from the tubular 60 into the storage tank 150 through the openings 230.

When the clam shell enclosure 110 is closed around the tubular string 66 (including the tubular 60), the joint connecting the tubular 60 to the tubular string 66 may have been untorqued by a roughneck (or other suitable tool) before the mud bucket 100 is moved to the well center 82. With the joint untorqued, but not yet unthreaded, the mud bucket 100 can be sealed around the joint of the tubular string 66. When the clam shell enclosure 110 is closed around the tubular string 66, a pipe handler (e.g., pipe handler 32, top drive, spinner, etc.) can begin unthreading the pin end 69 from the box end 67. At some point during the unthreading of the joint, fluid 240, 242 contained in the tubular 60 can be released or expelled from the tubular 60. Gravity can cause the fluid 240, 242 to flow from the tubular 60, into the chamber 200 and down through the openings 230 into the storage tank 150 (not shown).

Openings 230 may only exist at the bottom of the portion 112 which is fixed to the storage tank 150. Since the portion 114 rotates relative to the storage tank 150, it is preferred that no openings 230 are at the bottom of portion 114. Fluid 242 that is expelled from the tubular 60 into the portion 112, can travel directly through the openings 230 into the storage tank 150. Without openings 230 in the bottom of the portion 114, the fluid 240 that is expelled into the portion 114 will be directed to the openings 230 in the portion 112. To facilitate faster draining of the fluid 240 into the storage tank 150, an inclined surface 238 can be disposed at the bottom of the portion 114. The inclined surface 238 can be inclined toward the openings 230 and over a lip 239. The lip 239 provides a shallow dam for retaining fluid in the portion 112 at the completion of draining the fluids 240, 242 into the storage tank 150, where a small portion of the fluids 240, 242 may remain at the bottom of the portion 112. This lip 239 helps prevent spillage of the fluid 240, 242 that remains in the portion 112, when the clam shell enclosure 110 is opened. By having the inclined surface 238 deliver the fluid 240 over the lip 239, then a minimal amount of the fluid 240, 242 remaining in the portion 112 will be retained by the lip 239 and the seal half 220*a*.

The fluid 240, 242 can be expelled from the tubular 60 and stored in the storage tank 150 in less than 15 seconds, less than 14 seconds, less than 13 seconds, less than 12 seconds, less than 11 seconds, less than 10 seconds, less than 9 seconds, less than 8 seconds, less than 7 seconds, less than 6 seconds, or less than 5 seconds.

Figure 11A:
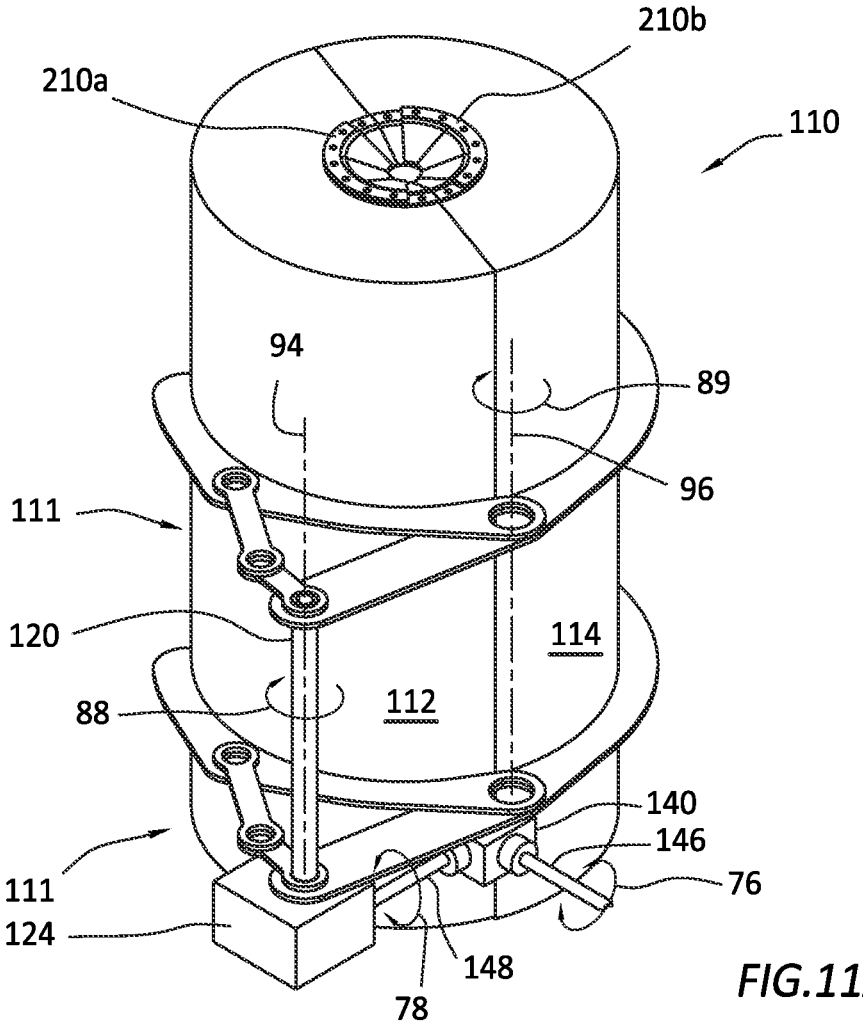
FIG. 11A is a representative perspective rear view of a clam shell enclosure of a mud bucket in a closed position, in accordance with certain embodiments.
Figure 11B:
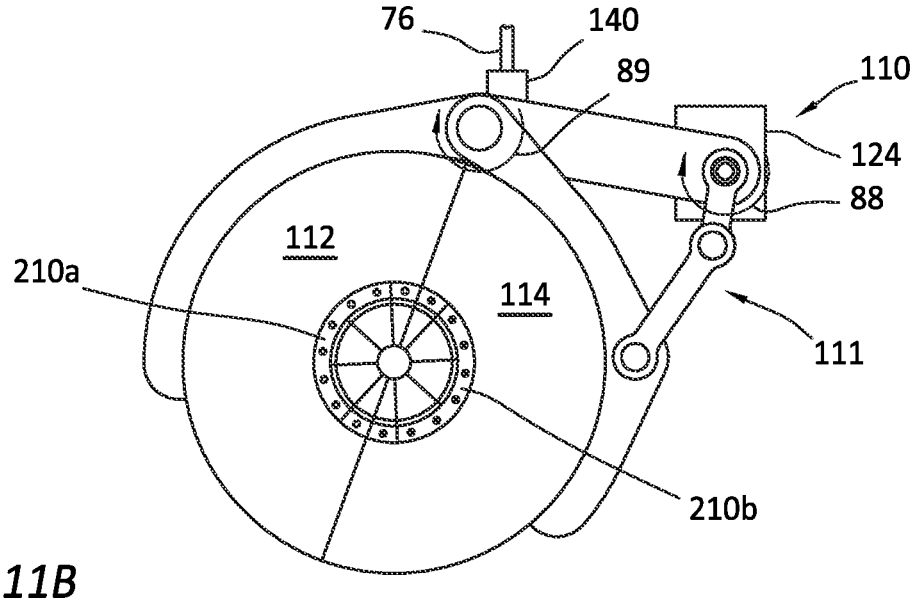
FIG. 11B is a representative top view of the clam shell enclosure of FIG. 11A in the closed position, in accordance with certain embodiments.

FIG. 11A is a representative perspective rear view of a clam shell enclosure 110 of a mud bucket 100 in a closed position, according to certain embodiments. FIG. 11B is a representative top view of the clam shell enclosure 110 of FIG. 11A in the closed position, according to certain embodiments. To close the clam shell enclosure 110, the tool interface 130 (not shown) can drive the actuator 124 through a coupling, which in this example includes drive shafts 146, 148 and a gear box 140. With the tool interface 130 rotating the drive shaft 146 in an appropriate direction (arrows 76), the drive shaft 148 can be rotated in a desired direction (arrows 78) via the gear box 140 which can transfer the torque from the drive shaft 146 to the drive shaft 148. Torque from the drive shaft 148 can be received by the actuator 124, which can cause the drive shaft 120 to rotate in a clockwise direction (arrow 88 about axis 94), thereby extending the linkage 111 against the portion 114 and rotating the portion 114 in a clockwise direction (arrow 89 about axis 96) into engagement with the portion 112 forming the sealed chamber 200 around a tubular string 66.

Figure 12A:
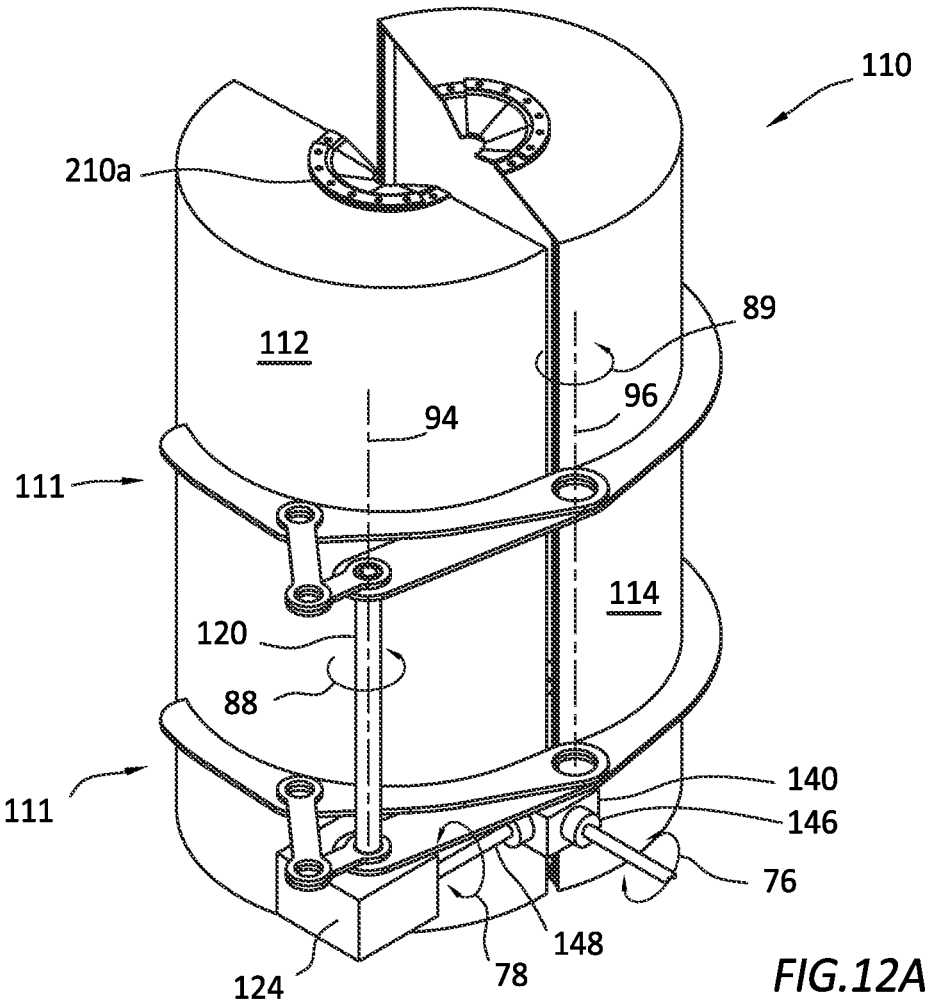
FIG. 12A is a representative perspective rear view of a clam shell enclosure of a mud bucket in an open position, in accordance with certain embodiments.
Figure 12B:
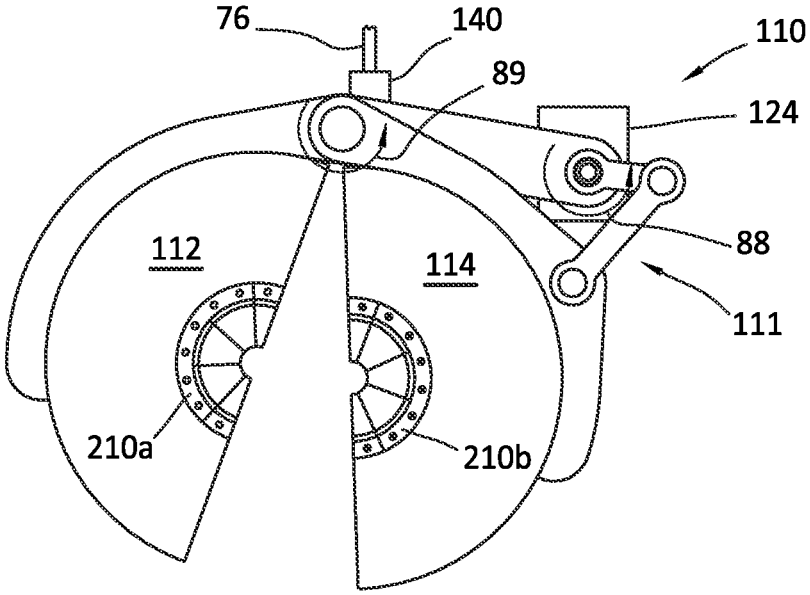
FIG. 12B is a representative top view of the clam shell enclosure of FIG. 12A in the open position, in accordance with certain embodiments.

FIG. 12A is a representative perspective rear view of a clam shell enclosure 110 of a mud bucket 100 in an open position, according to certain embodiments. FIG. 12B is a representative top view of the clam shell enclosure 110 of FIG. 12A in the open position, according to certain embodiments. To open the clam shell enclosure 110, the tool interface 130 (not shown) can drive the actuator 124 through a coupling, which in this example includes drive shafts 146, 148 and a gear box 140. With the tool interface 130 rotating the drive shaft 146 in an appropriate direction (arrows 76), the drive shaft 148 can be rotated in a desired direction (arrows 78) via the gear box 140 which can transfer the torque from the drive shaft 146 to the drive shaft 148. Torque of the drive shaft 148 can be received by the actuator 124, which can cause the drive shaft 120 to rotate in a counter-clockwise direction (arrow 88 about axis 94), thereby retracting the linkage 111 and rotating the portion 114 in a counter-clockwise direction (arrow 89 about axis 96) away from engagement with the portion 112.

Figure 13C:
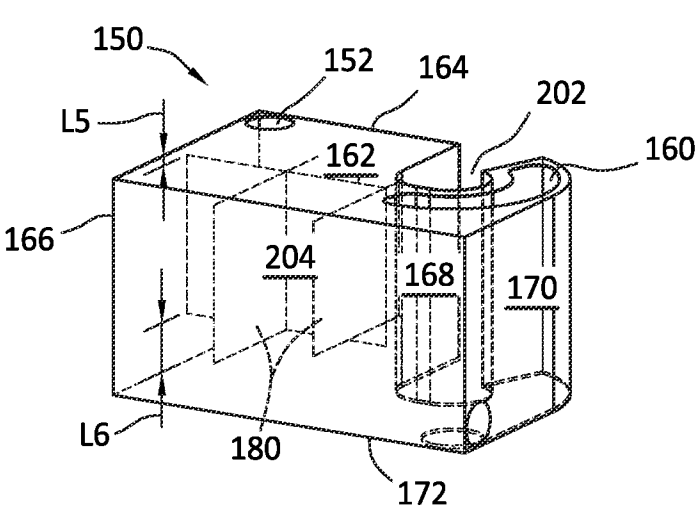
FIG. 13C is a representative perspective rear translucent view of a storage tank of a mud bucket, in accordance with certain embodiments.
Figure 13B:
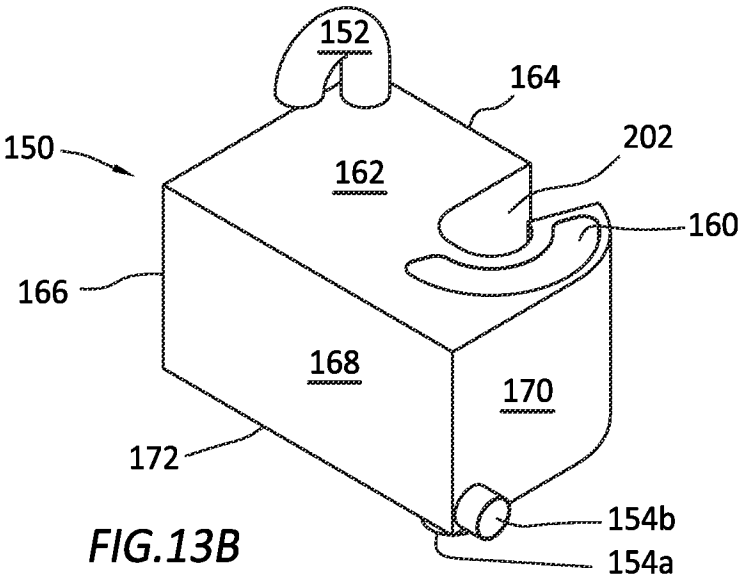
FIG. 13B is a representative perspective rear view of a storage tank of a mud bucket, in accordance with certain embodiments.
Figure 13A:
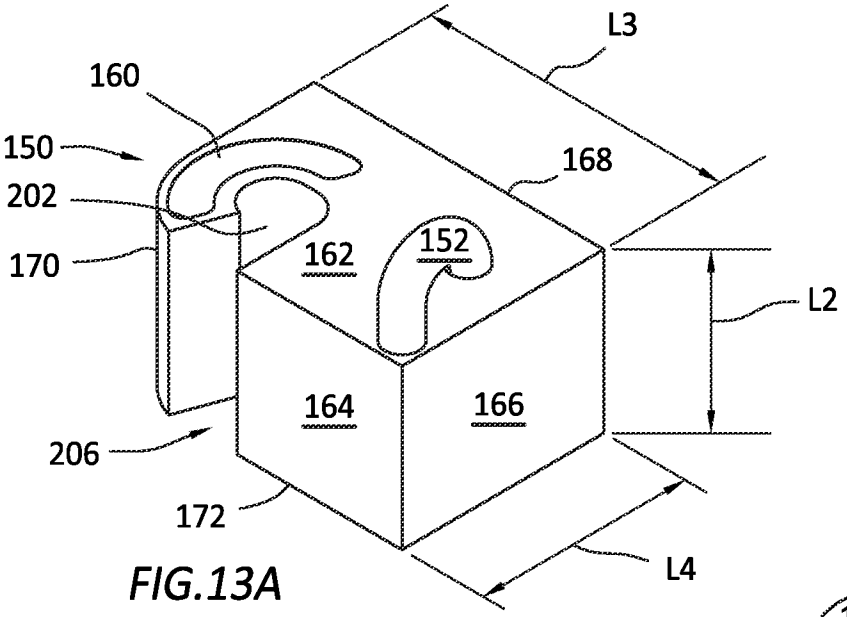
FIG. 13A is a representative perspective front view of a storage tank of a mud bucket, in accordance with certain embodiments.

FIG. 13A is a representative perspective front view of a storage tank 150 for a mud bucket 100, according to certain embodiments. The storage tank 150 can include a top 162, a front 164, a right side 166, a rear 168, a left side 170, and a bottom 172. An outlet 152 (e.g., a gas vent) can extend from the top 162 of the storage tank 150. A recess 202 can be formed in the storage tank 150 with access through an opening 206 in the front 164. The opening 206 allows a tubular string 66 to enter the recess 202 through the opening 206. The opening 160 in the top 162 can align with the openings 230 in the bottom of the portion 112, where the expelled fluids 240, 242 flow into the storage tank 150. The storage tank 150 can have a length L4, a width L3, and a height L2. These dimensions can be adjusted when the storage tank 150 is formed to accommodate various desired tank volumes. As way of an example, with a desired capacity of 750 liters, the height L2 can be equal to 723 mm, the length L4 can be equal to 920 mm, and the width L3 can be equal to 1290 mm. A storage tank 150 built per this embodiment and with these dimensions can at least 750 liters of fluid 240, 242.

FIG. 13B is a representative perspective rear view of a storage tank 150 for a mud bucket 100, according to certain embodiments. Two outlets 154*a*, 154*b* are shown that can be used to drain fluid from the storage tank 150. One outlet 154*a* can exit the bottom 172. This outlet 154*a* can have a valve (not shown) coupled to it, with the valve actuated between closed and opened positions when engaged with a docking station 250 or other suitable actuator. When it is desirable to drain the fluid from the storage tank 150, the conveyance (e.g., drill floor robot 20) can move the mud bucket 100 away from the well center 82 and the tubular string 66 to a location (e.g., a docking station 250) that can receive the fluid from the storage tank 150. When positioned at the desired discharge location, the valve can be actuated to discharge the fluid 240, 242 from the storage tank 150 into a collection chamber (e.g., mud pit). The valve can be actuated via wired or wireless control, mechanically actuated (e.g., flapper valve, a poppet valve), hydraulically actuated, or pneumatically actuated. For this example, at least 750 liters of fluid 240, 242 contained in the storage tank 150 can be drained from the storage tank 150 through the outlet 154*a* within 50 seconds, within 45 seconds, within 40 seconds, within 35 seconds, within 30 seconds, or within 25 seconds.

The discharge location can be a docking station 250 for the mud bucket 100, where the mud bucket 100 can be disengaged from the conveyance (e.g., drill floor robot 20) while the fluid is being drained from the storage tank 150 into the collection chamber. It is not a requirement that the mud bucket 100 be disengaged at the docking station 250, just that it can be disengaged from the conveyance if desired. This can free up the conveyance to perform other rig tasks while waiting for the fluid to drain and waiting for the next joint in the tubular string 66 to be in position for disconnection during a trip out procedure. The collection chamber can be a mud pit, a temporary storage chamber that can pump the expelled mud to mud pit for reuse later, or any other location that can receive the expelled fluid and save it until it is needed again for other subterranean operations. The docking station 250 can have a flapper valve that is opened only when the fluid is being discharged from the storage tank 150. This will help prevent any release of fluid from the collection chamber (e.g., release any gas drafts from a mud pit).

Alternatively, or in addition to, another outlet 154*b* can be formed in a side (e.g., left, right, front, or back) and can be used to drain the fluids from the storage tank 150 into a hose that may be connected to the outlet. The hose can be coupled to the outlet 154*b* during the mud bucket 100 operations, or the hose can be connected to the outlet 154*b* at other locations when the mud bucket 100 is moved to that location. The outlet 154*b* can also be controlled by a valve that can be actuated via wired or wireless control, mechanically actuated (e.g., flapper valve, a poppet valve), hydraulically actuated, or pneumatically actuated. The fluid 240, 242 contained in the storage tank 150 can be drained from the storage tank 150 through the outlet 154*b* within 50 seconds, within 45 seconds, within 40 seconds, within 35 seconds, within 30 seconds, or within 25 seconds. It may be preferable for the outlet 154*b* to be manually operated to drain the fluid in the storage tank 150 when the mud bucket 100 cannot be delivered to the docking station to drain fluid through the opening 154*a*. The outlet 154*b* can be used as an emergency drain to empty the storage tank 150 in the event the robot handling the mud bucket 100 breaks down or otherwise fails to deliver the mud bucket 100 to the docking station.

FIG. 13C is a representative perspective rear translucent view of a storage tank 150 for a mud bucket 100, according to certain embodiments. The sides of the storage tank 150 are shown as being translucent to allow viewing of the internal features of an example of the storage tank 150. Baffles 180 can be installed in an interior chamber 204 of the storage tank 150. These baffles 180 can prevent sloshing of the fluid contained in the storage tank 150 to reduce dislocation of a center of gravity of the storage tank 150 as it is being moved around on the rig floor 16. It is preferred that a gap L5 be provided between the top of the baffles 180 and the top 162 of the storage tank 150 to prevent gas from being trapped by the baffles 180 in the storage tank 150. It is also preferred that a gap L6 be provided between the bottom of the baffles 180 and the bottom 172 of the storage tank 150 to prevent (or at least reduce) relocation of a center of gravity of the storage tank 150 when it contains fluid and is moved around the rig 10.

Figure 14B:
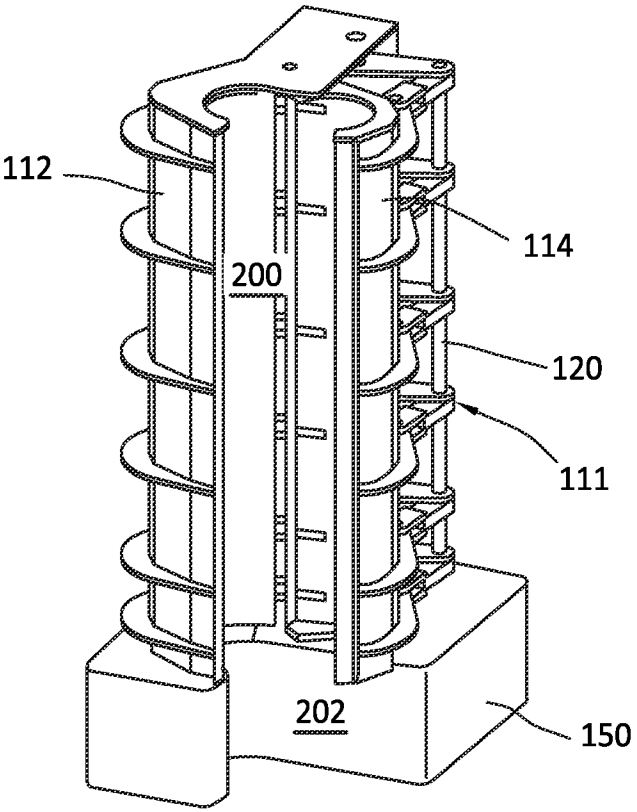
FIG. 14B is a representative perspective front view of a clam shell enclosure of a mud bucket with integral storage tank, in accordance with certain embodiments.
Figure 14A:
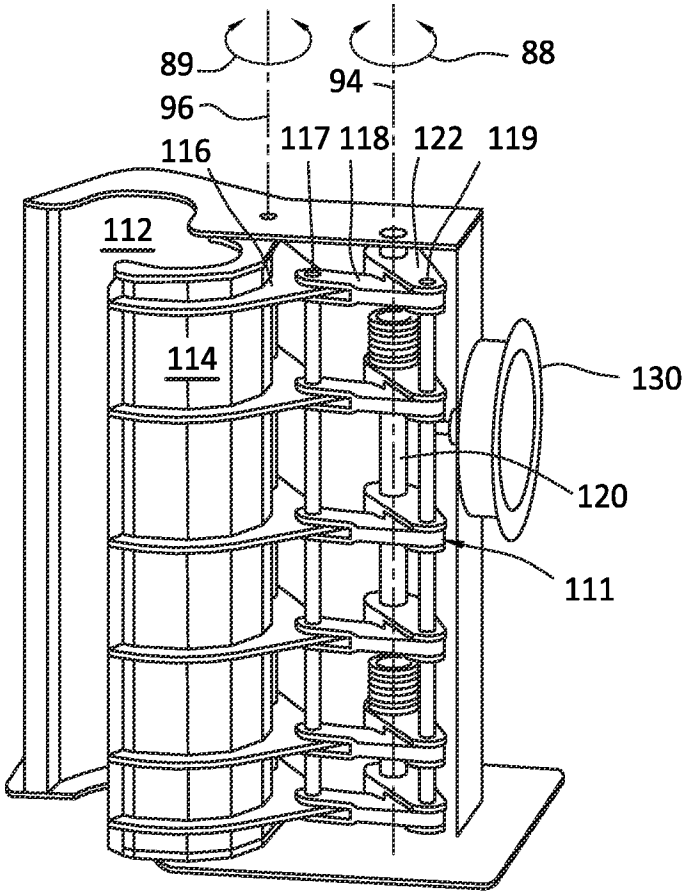
FIG. 14A is a representative perspective side view of a clam shell enclosure of a mud bucket, in accordance with certain embodiments.

FIGS. 14A and 14B are representative perspective views of a mud bucket 100, according to certain embodiments. Much like the mud bucket embodiments shown in FIGS. 2 thru 12B, the portion 112 remains stationary relative to the storage tank 150, with the portion 114 being rotationally attached to the portion 112 at the axis 96. Rotating the portion 114 (arrows 89) about the axis 96 can open or close the clam shell enclosure 110. This clam shell enclosure 110 has additional link assemblies 111 that can link the drive shaft 120 to the portion 114. Rotational drive from the tool interface 130 can be coupled to an actuator (not shown) that can rotate (arrows 88) the drive shaft 120 about the axis 88. The sealed chamber 200 can be formed when the portions 112, 114 are engaged with each other in a closed configuration around the tubular string 66. The recess 202 is formed differently than the previously described example, but the storage tank 150 can still provide access through a side of the storage tank 150 to allow entrance of the tubular string 66 into the recess 202 and the clam shell enclosure 110.

Figure 15:
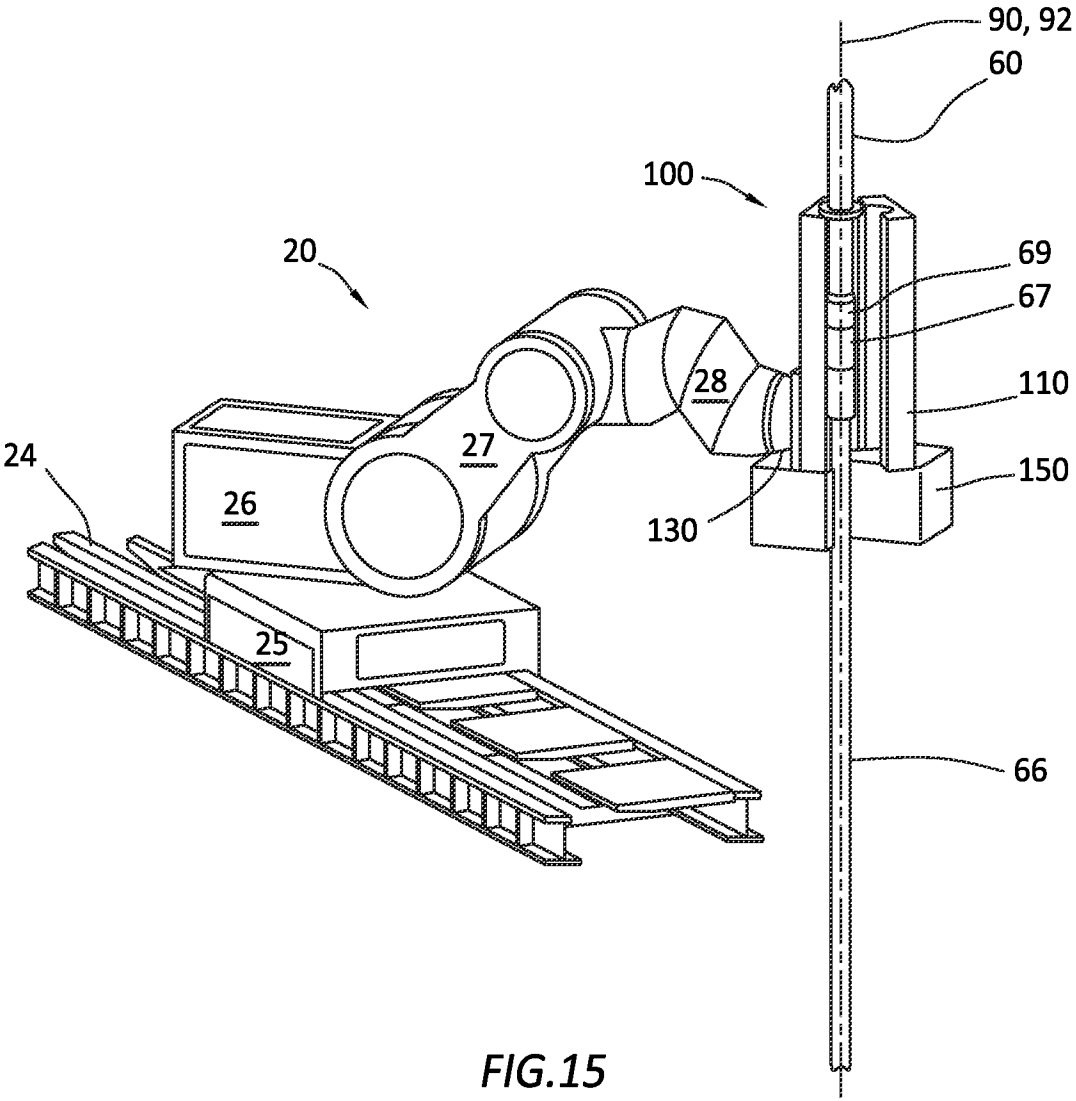
FIG. 15 is a representative side view of a drill floor robot engaging a tubular string with a mud bucket, in accordance with certain embodiments.

FIG. 15 is a representative side view of a drill floor robot 20 engaging a mud bucket 100 (as shown in FIGS. 14A, 14B) with a tubular string 66, according to certain embodiments. The conveyance (e.g., the drill floor robot 20 in this example) can manipulate the mud bucket 100 to align the center longitudinal axis 90 of the clam shell enclosure 110 with the longitudinal axis 92 of the tubular string 66. The portion 114 can be rotated to the closed position sealing around the joint of the tubular string 66. The tubular 60 can then be unthreaded from the tubular string 66 expelling fluid contained in the tubular 60 into the chamber 200 and through openings 160, 230 into the storage tank 150. When the expelled fluid is captured in the storage tank 150, the portion 114 can be rotated to the open position, the mud bucket 100 can be moved away from the tubular string 66 and moved to a discharge location (e.g., a docking station 250) to empty the storage tank 150 into a collection chamber.

Figure 16:
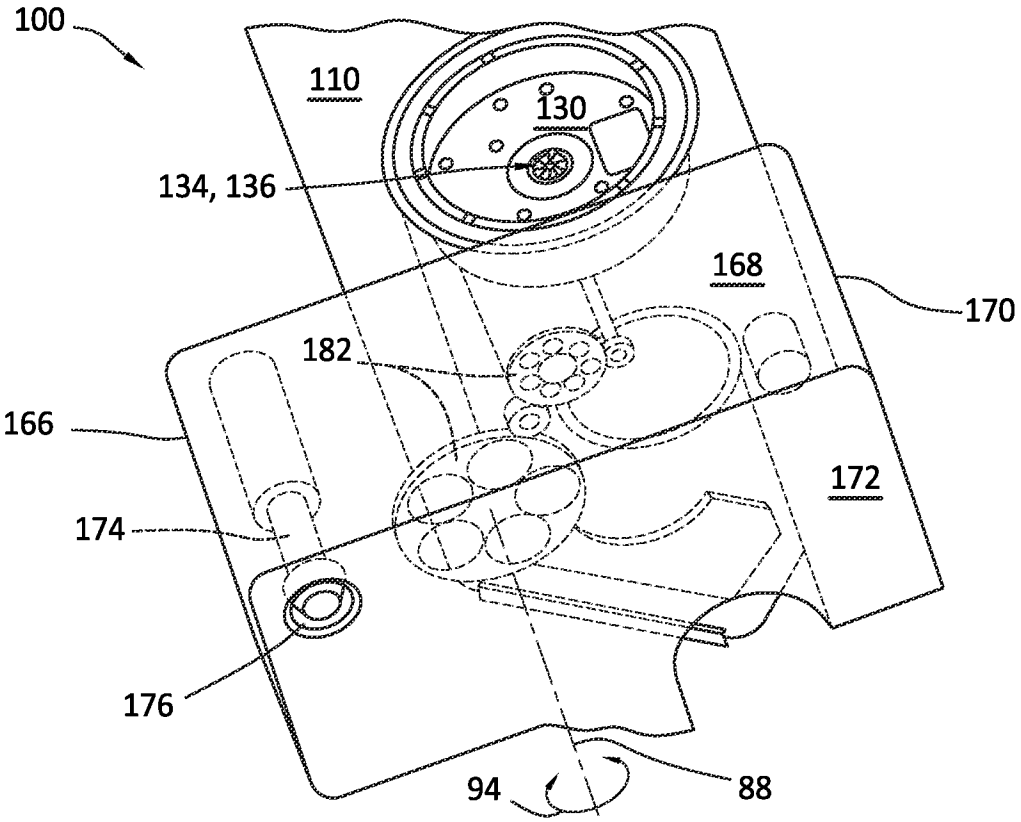
FIG. 16 is a representative perspective bottom translucent view of a storage tank of a mud bucket, in accordance with certain embodiments.

FIG. 16 is a representative perspective bottom translucent view of a storage tank 150 of a mud bucket 100, according to certain embodiments. Gears 182 can be disposed in the interior chamber of the storage tank 150. The gears 182 can couple the rotational drive from the tool interface 130 to the drive shaft 120 which rotates about the axis 94 (arrows 88). Various other gear configurations can be used to couple the rotational drive from the tool interface 130 to the drive shaft 120 for rotating the portion 114 between open and closed positions. A poppet valve 174 can be operated to empty the fluid 240, 242 from the storage tank 150 at the discharge location. A structure at the discharge location can be used to move the poppet valve away from the opening 176 to release the fluid 240, 242 from the storage tank 150 into an inlet of the collection chamber.

Figure 17:
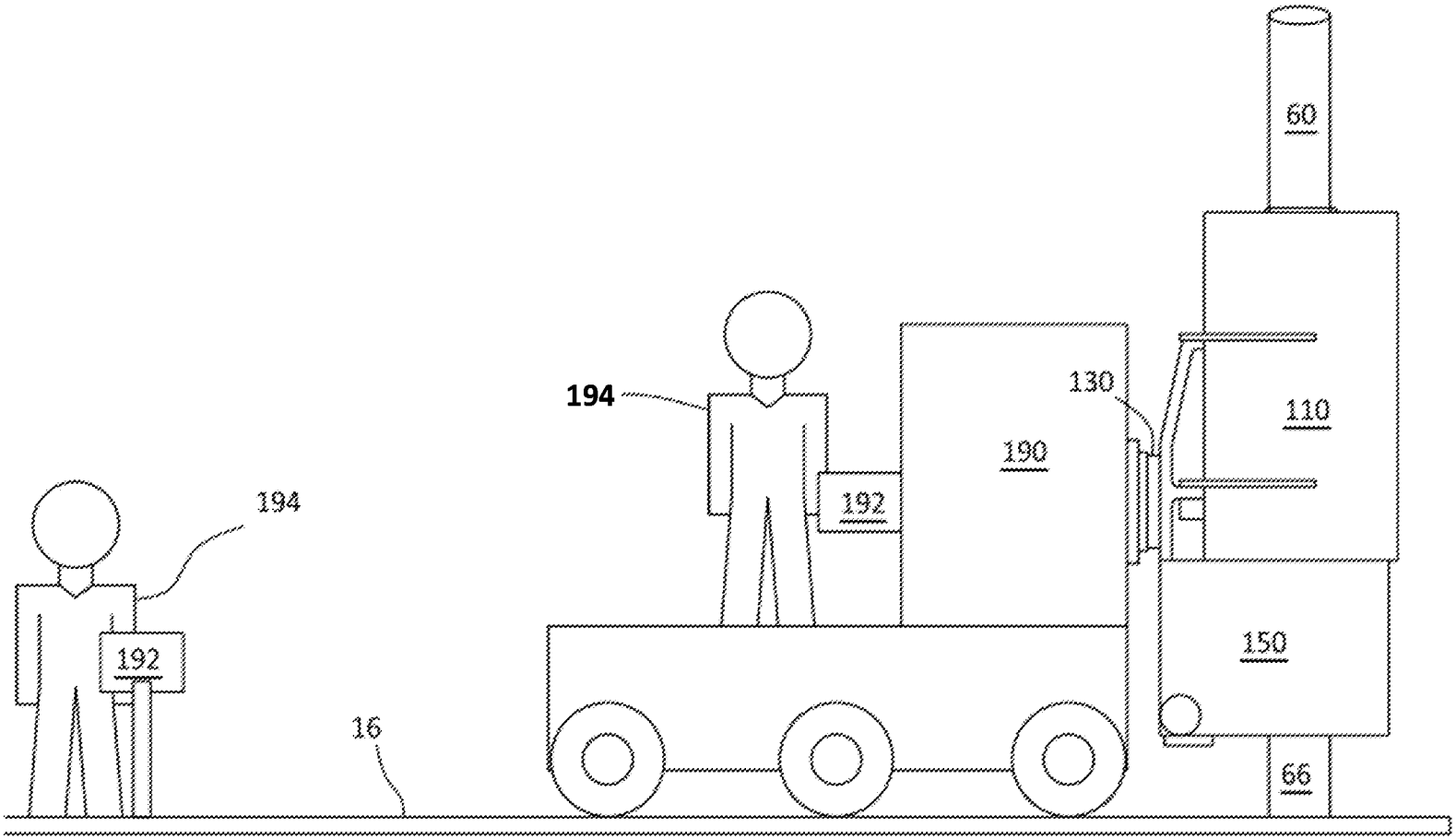
FIG. 17 is a representative side view of a manually operated cart carrying a mud bucket and engaging a tubular string, in accordance with certain embodiments.

FIG. 17 is a representative side view of a manually operated mobile cart 190 that can be used as an alternative to the previously described drill floor robot 20. The mobile cart 190 can engage the mud bucket 100 at the tool interface 130 and thereby attach the mud bucket 100 to the mobile cart 190. The mobile cart 190 can be operated by rig personnel 194 via a control console 192. The control console 192 can be on the mobile cart 190 or positioned at a remote location where the rig personnel 194 can safely operate it. The mobile cart 190 can convey the mud bucket 100 to and from the well center 82 to collect the expelled fluid from the tubular 60 and discharge the fluid from the storage tank 150 at a discharge location remote from the well center 82.

Figure 18:
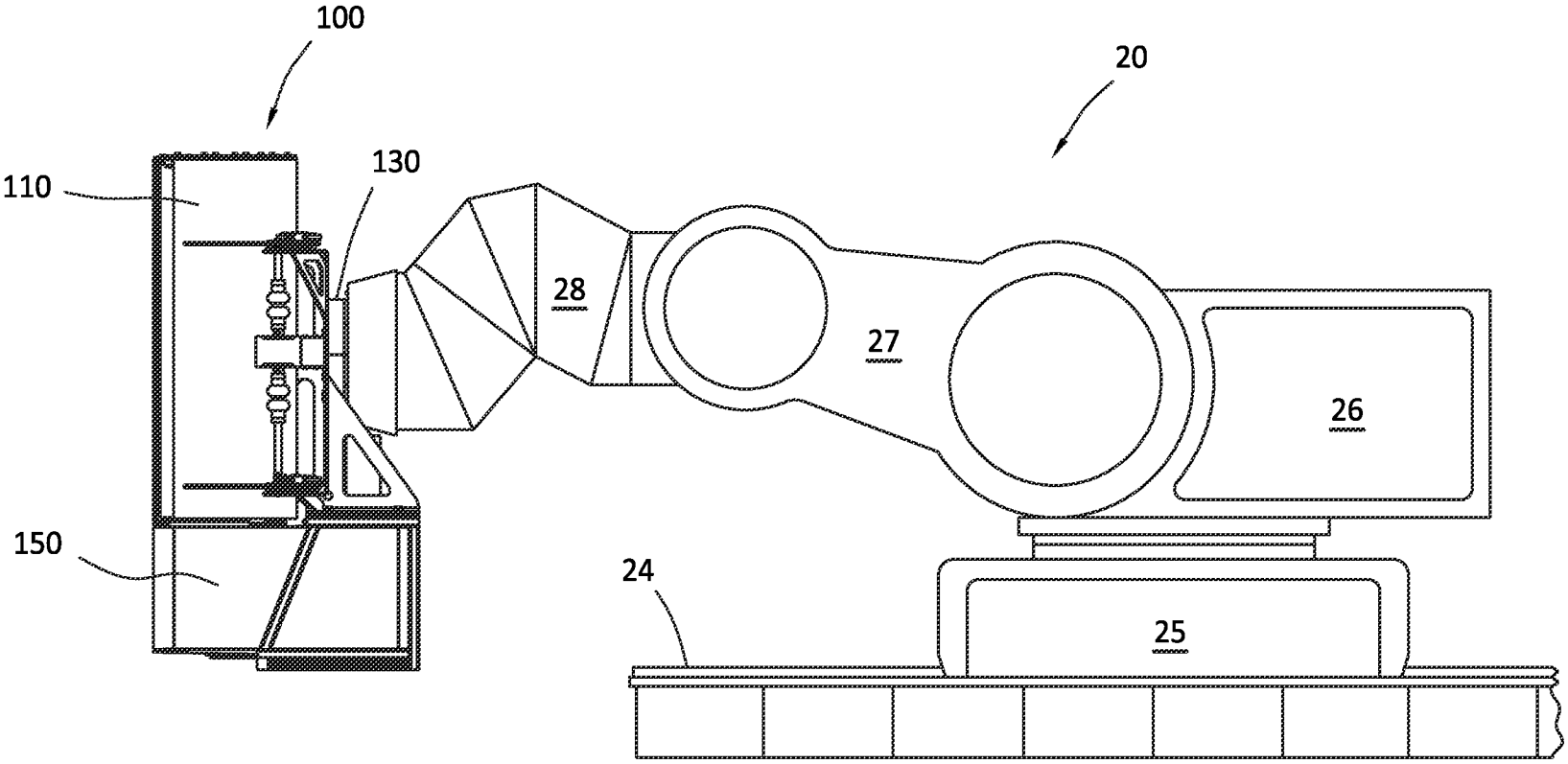
FIG. 18 is a representative side view of a drill floor robot carrying a mud bucket, in accordance with certain embodiments.

FIG. 18 is a representative side view of a drill floor robot 20 carrying a mud bucket 100, in accordance with certain embodiments. This mud bucket 100 is similar to the previously described mud bucket 100 embodiments. It should be understood that the previous description also applies to this mud bucket 100 except were specifically shown and described below to be different.

Figure 19B:
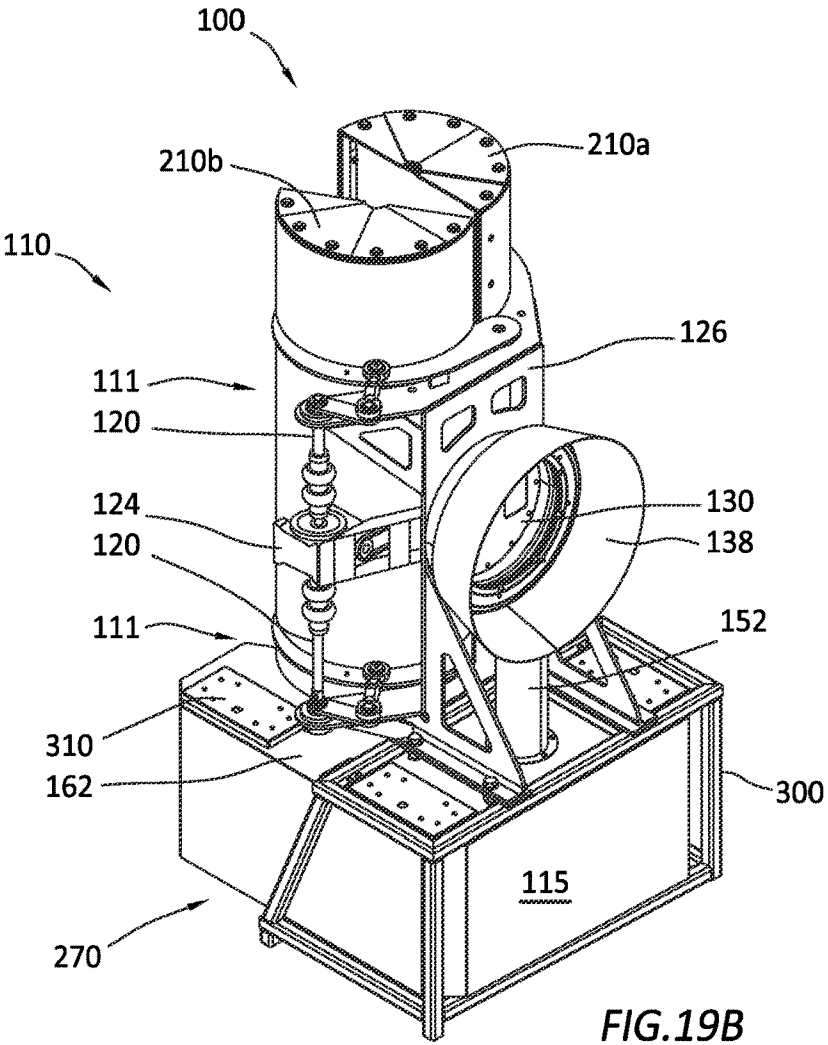
FIGS. 19A, 19B are representative perspective views of a mud bucket, in accordance with certain embodiments.
Figure 19A:
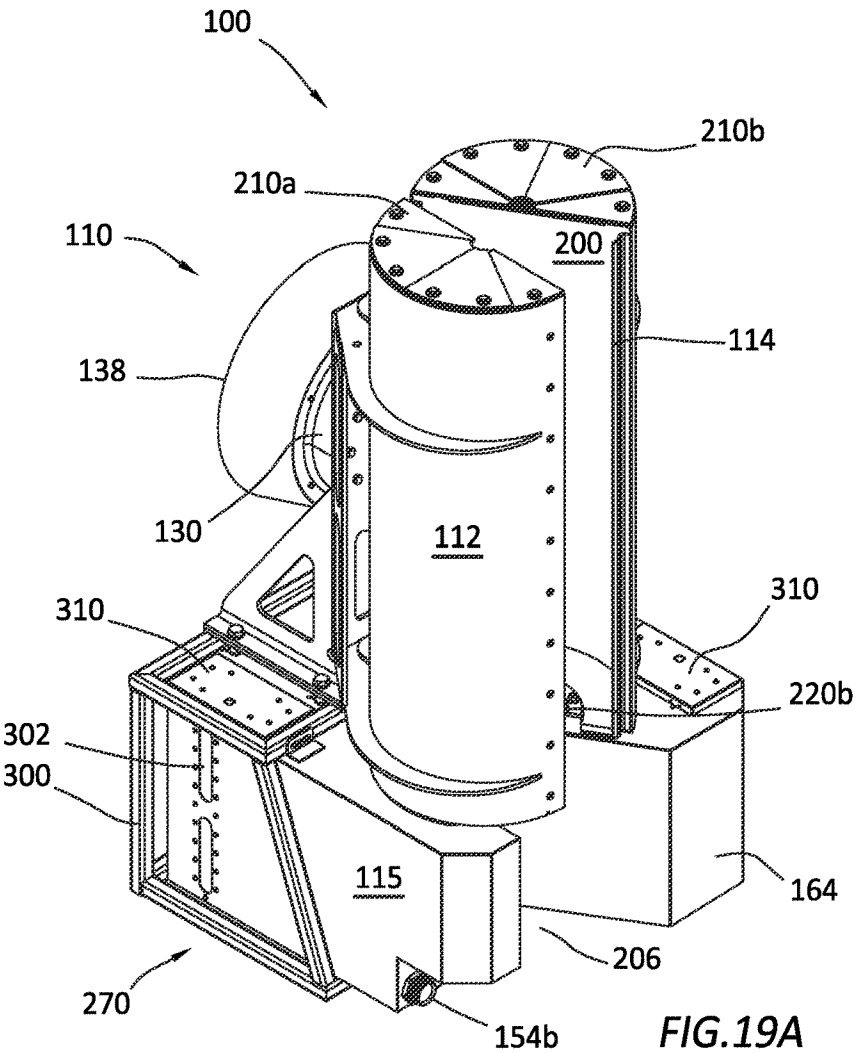
Figure 20B:
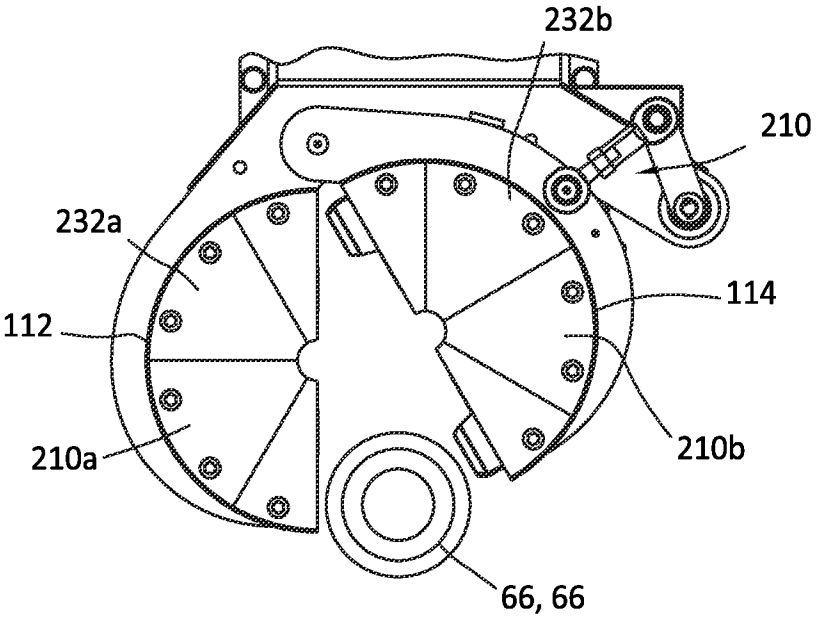
FIG. 20B is a representative top view of a top seal of the mud bucket of FIG. 20A, in accordance with certain embodiments.
Figure 20A:
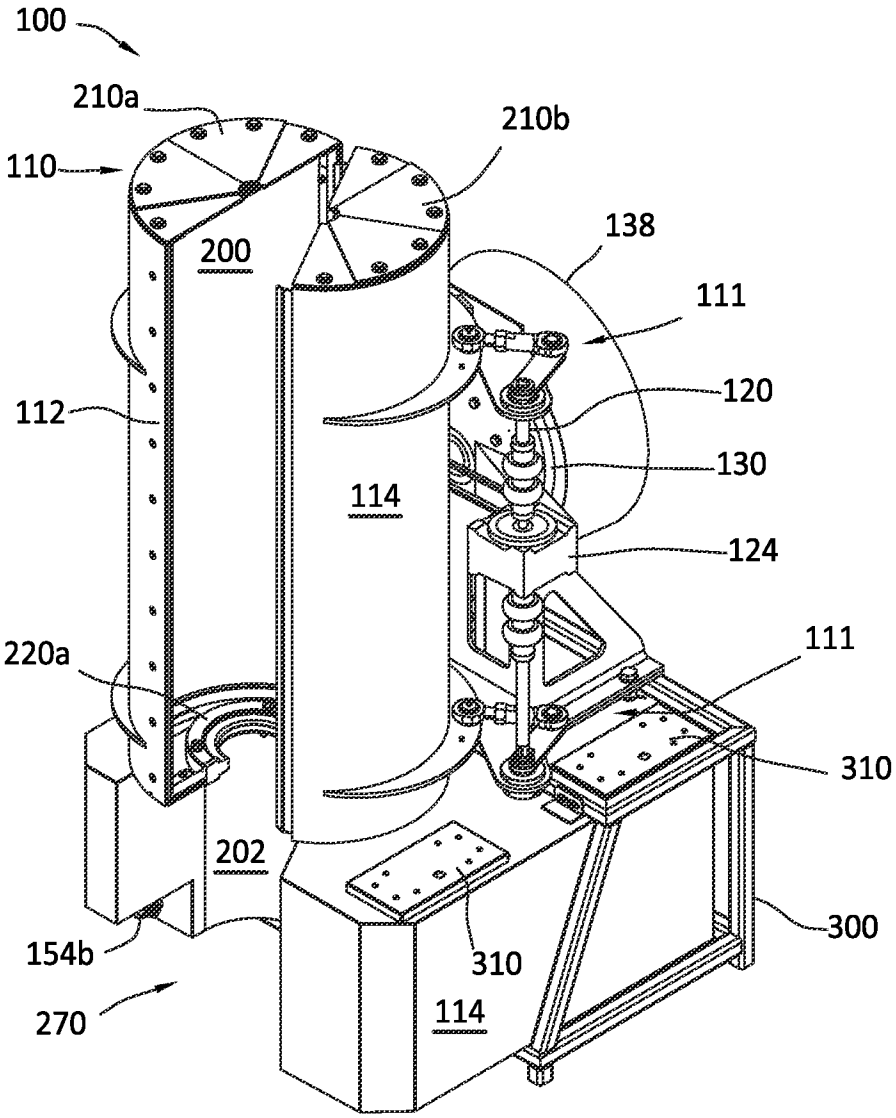
FIG. 20A is a representative perspective front view of a mud bucket, in accordance with certain embodiments.

FIGS. 19A, 19B, 20A are representative perspective views of a mud bucket 100 with an integral storage tank assembly 270 (which includes the integral storage tank 150), in accordance with certain embodiments. Similar to previously described embodiments, the mud bucket 100 can include a clam shell enclosure 110 with portions 112, 114. The clam shell portion 112 can be removably attached to a storage tank assembly 270, and rotationally fixed to the storage tank assembly 270. The portion 114 can be rotationally coupled to the portion 112, such that the portion 114 can rotate relative to the portion 112 and relative to the storage tank assembly 270 between closed, open and partially open configurations. The storage tank assembly 270, can include a frame 300 and the storage tank 150, with the frame 300 providing structural support for the storage tank 150. The frame 300 can be removably attached to a rear portion of the storage tank 150 as shown in FIGS. 19A, 19B, 20A.

The storage tank 150 can include the opening 206 that allows tubulars to enter the mud bucket 100 from the front side 164 of the storage tank 150. An outlet 154*b* can be used to drain fluid from the storage tank 150 whenever the main outlet 154*a* is unavailable, such as when the mud bucket 100 is not resting in the docking station 250. Of course, the outlet 154*b* can be used at any appropriate time, but it is preferred that it be used as an emergency outlet for draining the storage tank 150A when the mud bucket 100 is immobile. The tool interface 130 can be used to interface a drill floor robot 20 to the mud bucket 100 for manipulation and control of the mud bucket 100, as described in more detail regarding previously described embodiments. A shield 138 can be used to reduce or prevent debris from entering the coupling of the tool interface 130 to the drill floor robot 20.

Access doors 310 provide access to various compartments within the storage tank 150 to facilitate maintenance and cleaning of the internal chambers of the storage tank 150. These access doors 310 are latched and sealed during operation. A fluid level indicator 302 can be used to measure and monitor a fluid level within the storage tank 150 by visual inspection. However, the fluid level indicator 302 is not required and the mud bucket 150 can be provided without the fluid level indicator 302. The fluid level indicator 302 can include a clear tube in fluid communication between the top and bottom of the storage tank 150. This allows the fluid level in the fluid level indicator 302 to mimic the fluid level in the storage tank 150.

The outlet 152, in this configuration, is a straight pipe section extending from the top surface 162 of the storage tank 150. Since the outlet 152 is below and covered by the shield 138, it does not need to be like the U-shaped versions as in previous embodiments.

The support 126 provides structural support for the portions 112, 114, the tool interface 130, the storage tank assembly 270, the actuator 124, the drive shaft 120, and the link assemblies 111. The seals 210*a*, 210*b*, 220*a*, 220*b* sealingly engage a tubular string when the tubular string 66 is positioned within the chamber 200 of the clam shell enclosure 110.

FIG. 20B is a representative top view of the seal assembly 210 of the mud bucket of FIG. 20A, in accordance with certain embodiments. The two halves 210*a*, 210*b* can form the seal assembly 210 when the portions 112, 114 are in the closed position. The seal assembly 210 can form an opening 234 through the center of the seal assembly 210 with a diameter D5 (see FIG. 9B). The difference between the seal assembly 210 of FIG. 9B and this seal assembly 210 is that the assembly 210 in FIG. 20B covers most if not all of the top of the clam shell enclosure 110. The diameter D5 can vary to accommodate tubulars 60, 66 of different outer diameters D1 and D2. The seal assembly 210 can include multiple arcuate resilient seal segments 232*a*, 232*b* which may overlap its neighbor (i.e., adjacent segments) to minimize gaps as the segments are flexed to accommodate the tubular 60, 66.

Figure 20C:
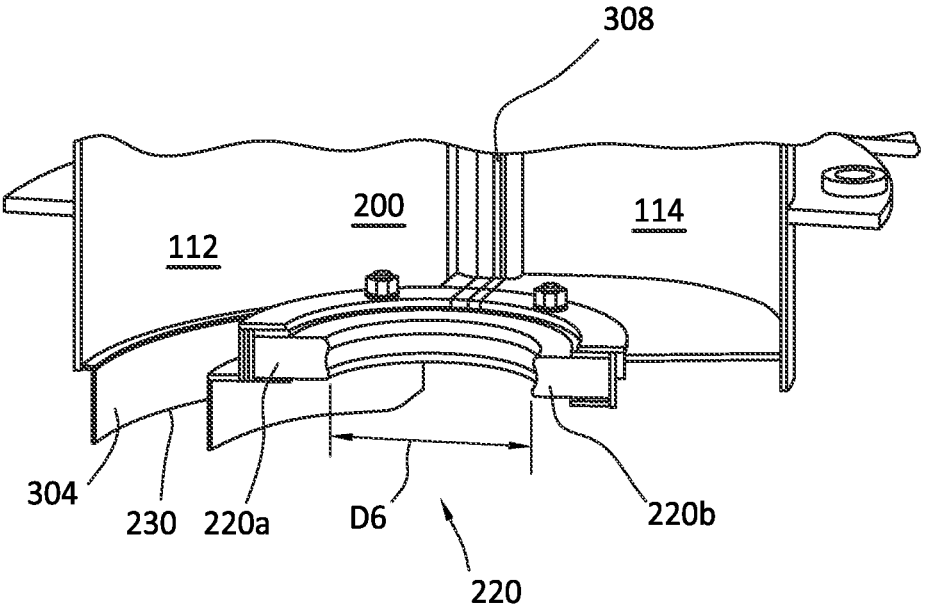
FIG. 20C is a representative partial cross-sectional view of a bottom seal of the mud bucket of FIG. 20A, in accordance with certain embodiments.

FIG. 20C is a representative partial cross-sectional view of a lower seal assembly 220 of the mud bucket 100 of FIG. 20A, in accordance with certain embodiments. The lower seal assembly 220 can include seals 220*a*, 220*b*. FIG. 20C shows the portion 114 rotated to engage the portion 112 to form the sealed chamber 200. The resilient ends of the seal 220*a* engage the resilient ends of the seal 220*b* to seal between the seals 220*a*, 220*b*. The resulting curved inner surface of the seal assembly 220 can engage a tubular to prevent fluid from passing between the seal assembly 220 and the tubular string 66 when the portion 114 is engaged with the portion 112 in the closed position of the mud bucket 100.

The seals 220*a*, 220*b* form a seal assembly 220 with an inner diameter of D6. This diameter D6 can vary incrementally when the seal assembly engages and disengages the tubular string 66. Various diameters of tubular strings 66 can be accommodated by replacing the seals 220*a*, 220*b* with other seals 220*a*, 220*b* that adjust the diameter D6 to a desired diameter. The seals 220*a*, 220*b* can be mounted from below into a cavity formed in each portion 112, 114, with fasteners (e.g., nuts) coupled to protrusions (e.g., threaded studs) that protrude from the top of the seals 220*a*, 220*b* through holes in the top of the cavities in the portions 112, 114. A seal 308 can be used to seal between edges of the portions 112, 114 when the mud bucket 100 is in the closed position.

Figure 20D:
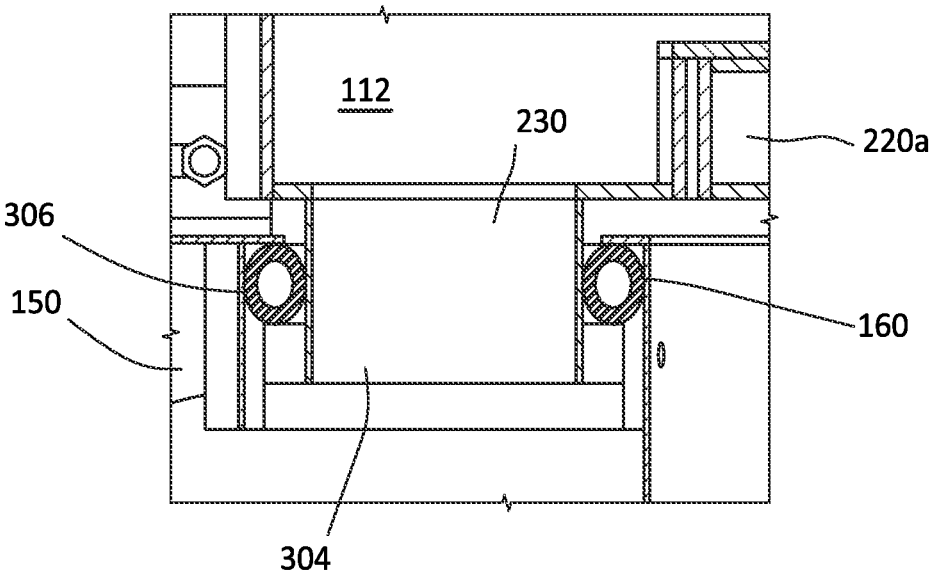
FIG. 20D is a representative partial cross-sectional view an interface between the clam shell enclosure and a storage tank of the mud bucket of FIG. 20A, in accordance with certain embodiments.

FIG. 20D is a representative partial cross-sectional view of an interface between the clam shell enclosure 110 and a storage tank 150 of the mud bucket of FIG. 20A, in accordance with certain embodiments. The extension 304 extends from the opening 230 of the portion 112 and can protrude through the opening 160 in the storage tank 150 to provide sealing between the portion 112 and the storage tank 150 when the mud bucket 100 is assembled. A seal 306 positioned around the opening 160 engages an outer surface of the protrusion 304 to prevent fluid from spilling out of the opening 160 during operation.

Figure 21B:
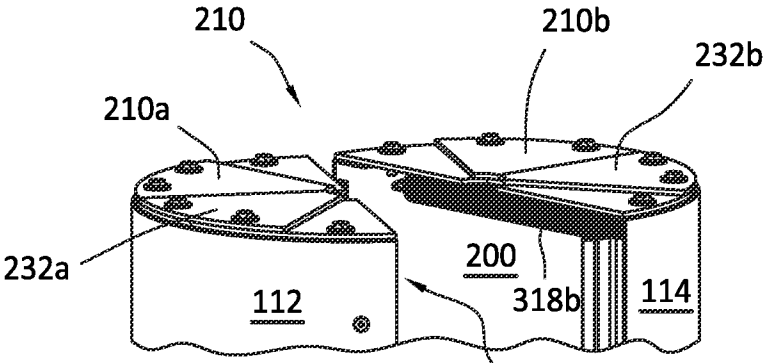
FIG. 21B is a representative perspective partial front view of a top seal of the mud bucket of FIG. 20A, in accordance with certain embodiments.
Figure 21D:
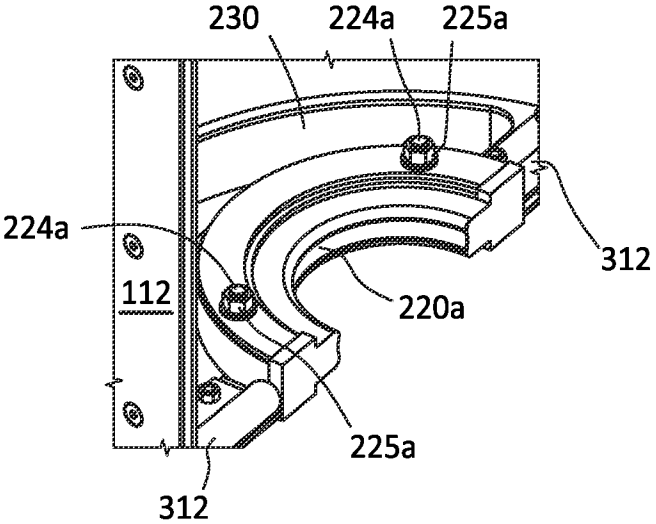
FIG. 21D is a representative perspective view of bottom seals of the clam shell enclosure of FIG. 20A, in accordance with certain embodiments.
Figure 21A:
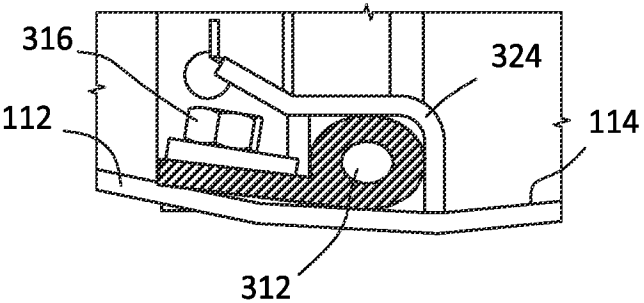
FIG. 21A is a representative partial cross-sectional view of a seal between the clam shell enclosure of the mud bucket of FIG. 20A, in accordance with certain embodiments.

FIG. 21A is a representative partial cross-sectional view of a seal 312 between the portions 112, 114 of the clam shell enclosure 110 of the mud bucket 100 of FIG. 20A, in accordance with certain embodiments. The seal 312 can be secured to the edge of the portion 112 via fasteners 316. A flange 314 can be formed along the edge of the portion 114, the flange having a tapered edge that guides the seal 312 into engagement between the flange 314 and the edge of the portion 112 to form sealing engagement between the portions 112, 114 along their edges.

FIG. 21B is a representative perspective partial front view of a top seal of the mud bucket of FIG. 20A, in accordance with certain embodiments. The seal assembly 210 can include multiple arcuate resilient seal segments 232*a*, 232*b* which may overlap its neighbor (i.e., adjacent segments) to minimize gaps as the segments are flexed to accommodate the tubular 60, 66. Due to the length of the resilient seal segments 232*a*, 232*b*, these segments 232*a*, 232*b* may tend to droop down from the outer edges that are attached to the portions 112, 114.

This drooping is beneficial, since the drooping causes the seal segments 232*a*, 232*b* to be forced downward when the clam shell portions 112, 114 are in a closed position and engage a tubular 60, 66. The drooping can be limited by securing a biasing device 318*a*, 318*b* below the respective seal segments 210*a*, 210*b*. The biasing device 318*a*, 318*b* (e.g., a spring, a resilient cord, etc.) allows the seal segments 210*a*, 210*b* to droop a desired amount without allowing the segments to droop more than desired. When the seal segments 210*a*, 210*b* engage a tubular 60, 66, the biasing devices 318*a*, 318*b* allow the seal segments 210*a*, 210*b* to be forced further downward as they engage and seal against the tubular 60, 66. The biasing devices 318*a*, 318*b* then return the seal segments 210*a*, 210*b* to the original positions when the portions 112, 114 are opened.

Figure 21C:
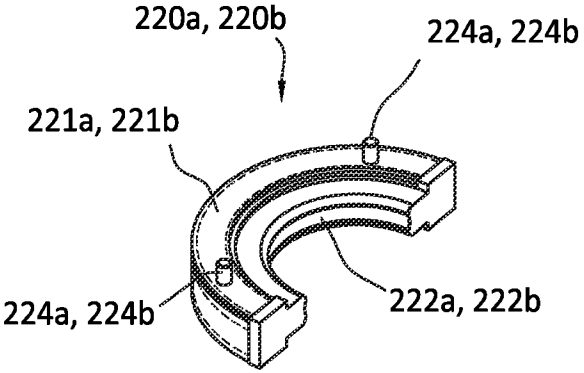
FIG. 21C is a representative perspective view of a bottom seal assembly of the clam shell enclosure of FIG. 20A, in accordance with certain embodiments.

FIG. 21C is a representative perspective view of a bottom seal 220*a* of the clam shell enclosure 110 of FIG. 20A, in accordance with certain embodiments. The bottom seal 220*a* can include a seal carrier 221*a* with protrusions 224*a* (e.g., threaded studs) extending from a top surface of the carrier 221*a*. A seal insert 222*a* can be inserted into the channel of the carrier 221*a* to form the seal 220*a*. Similarly, the bottom seal 220*b* can include a seal carrier 221*b* with protrusions 224*b* (e.g., threaded studs) extending from a top surface of the carrier 221*b*. A seal insert 222*b* can be inserted into the channel of the carrier 221*b* to form the seal 220*b*.

As seen in FIG. 21D the seal 220*a* can be assembled into a curved recess in the portion 112 by extending the protrusions 224*a* through holes in the portion 112 and coupling the protrusion 224*a* with a retainer 225*a* (e.g., stud extended through the holes in the portion 112 with nuts threaded onto the studs to hold the seal 220*a* in place).

Figure 22B:
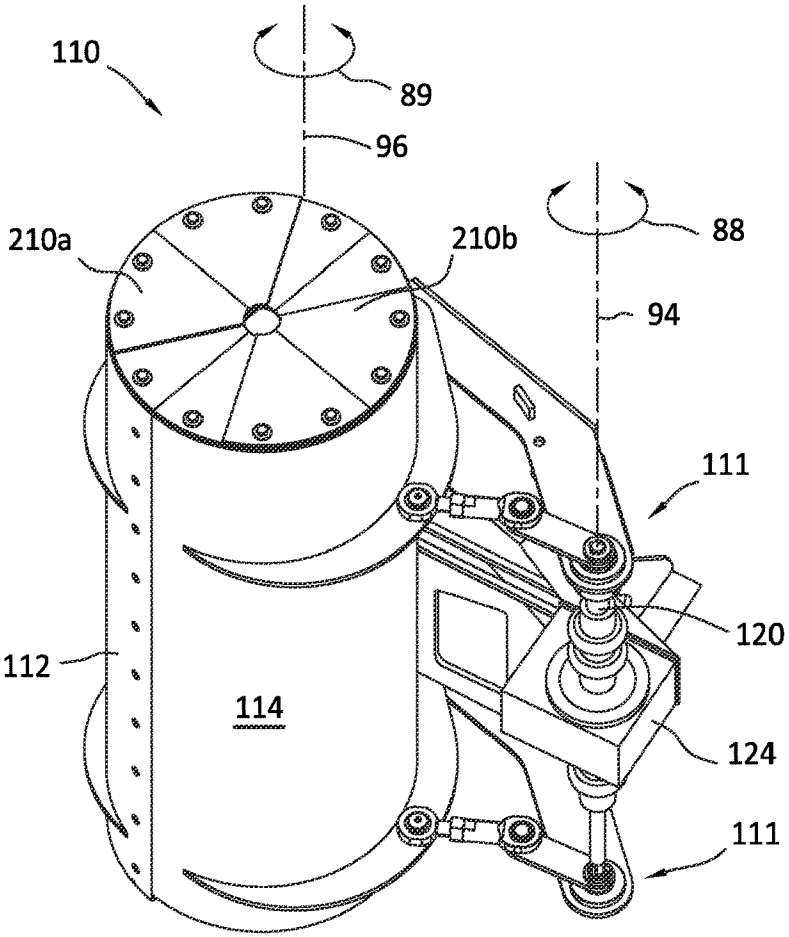
FIG. 22B is a representative perspective front view of a clam shell enclosure of the mud bucket of FIG. 20A in a closed position, in accordance with certain embodiments.
Figure 22A:
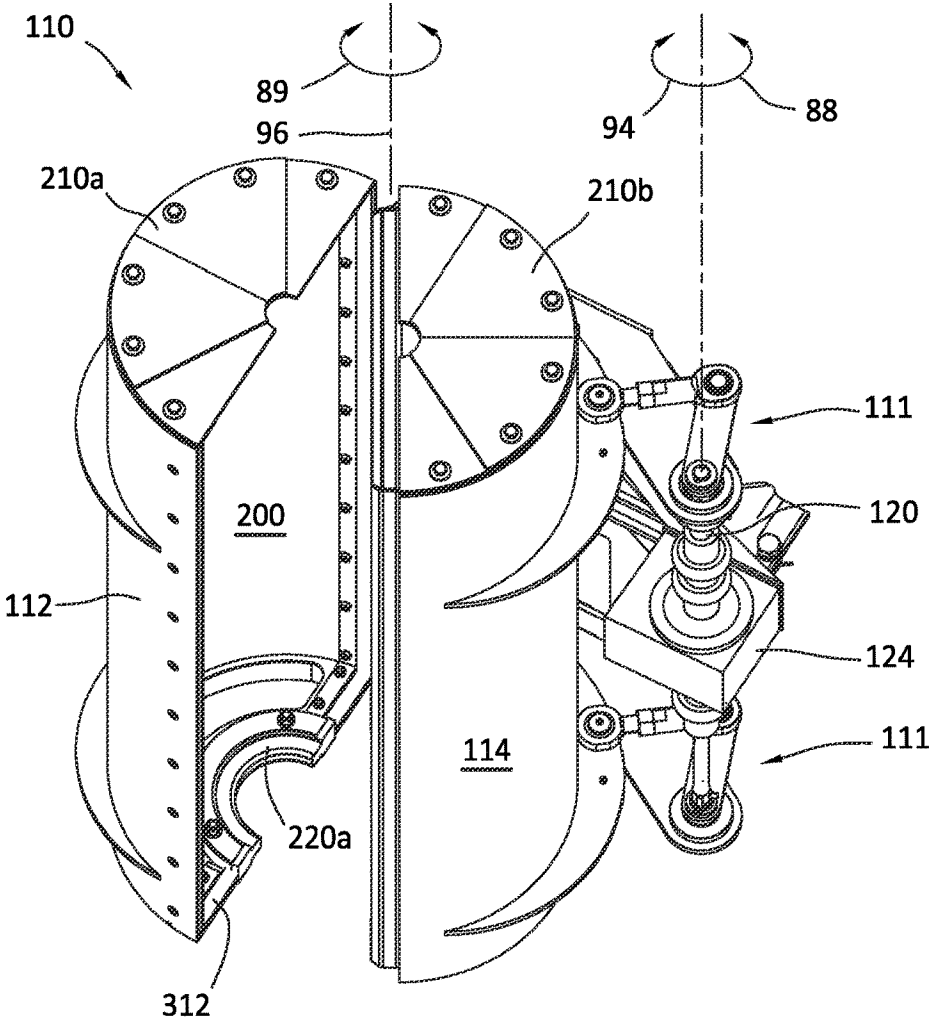
FIG. 22A is a representative perspective front view of a clam shell enclosure of the mud bucket of FIG. 20A in an open position, in accordance with certain embodiments.

FIG. 22A is a representative perspective front view of a clam shell enclosure 110 of the mud bucket 100 of FIG. 20A in an open position, in accordance with certain embodiments. The actuator 124 is operated by couplings to the tool interface 130. Rotational force is received at the tool interface 130 (e.g., from a drill floor robot 20) and transferred to the actuator 124. The actuator 124 can rotate the drive shaft 120 in response to receiving the rotational force. The drive shaft 120 can rotate (arrows 88) about the axis 94 and cause the linkage assemblies 111 to rotate the portion 114 (arrows 89) about the axis 96. Each linkage assembly 111 can have adjustable links that provide adjustability of the linkage assembly 111.

FIG. 22B is a representative perspective front view of a clam shell enclosure of the mud bucket of FIG. 20A in a closed position, in accordance with certain embodiments. With the drive shaft 120 rotated to extend the linkage assemblies 111 and engage the portion 114 with the portion 112, the clam shell enclosure 110 is in a closed position. The actuator 124 is self-locking, such that when the actuator 124 rotates the portion 114 (via the drive shaft and linkage assemblies) to the closed position, it does not allow rotational forces on the drive shaft 120 to rotate the actuator. The forces applied to the linkage assemblies 111 and thus the portion 114 may not be releasable until the input from the tool interface rotates the actuator 124 in the reverse direction. To open the clam shell enclosure 110, the tool interface is rotated in an opposite direction relative to the direction in which it was rotated to close the clam shell enclosure 110. This reverse rotation causes the actuator 124 to rotate the drive shaft 120 in an opposite direction and retracts the linkage assemblies 111, thereby rotating the portion 114 to an open position.

Figure 23B:
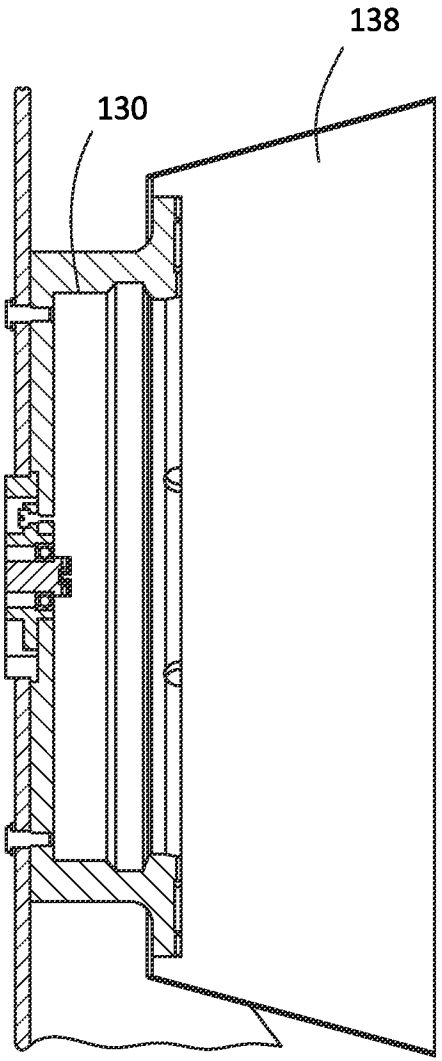
FIG. 23B is a representative side view of the tool interface of the mud bucket of FIG. 20A, in accordance with certain embodiments.
Figure 23A:
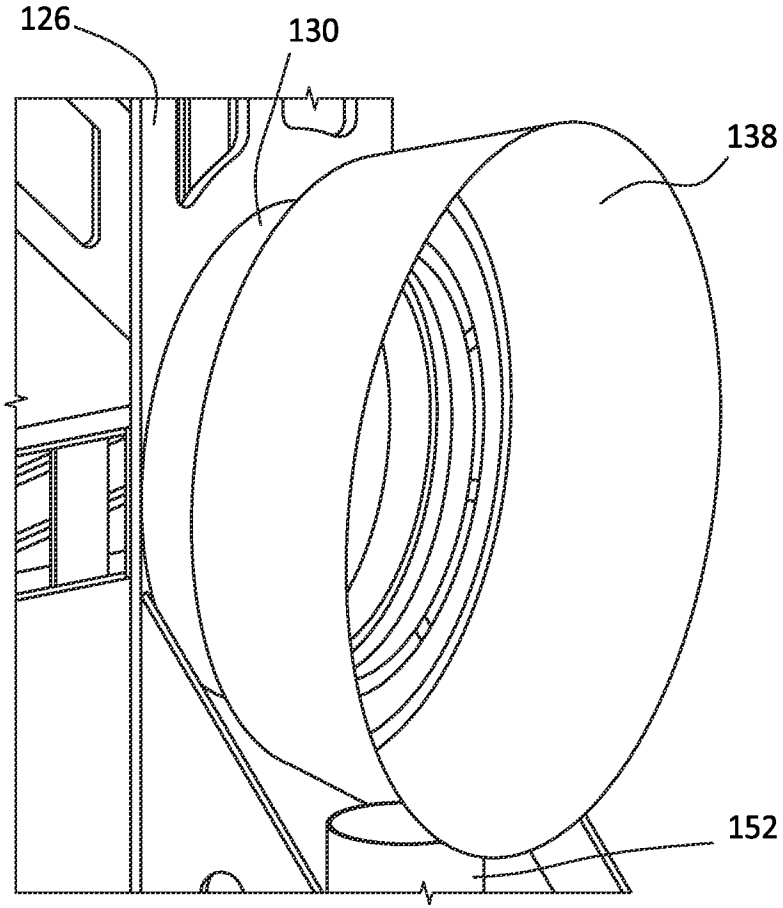
FIG. 23A is a representative perspective view of a tool interface of the mud bucket of FIG. 20A, in accordance with certain embodiments.

FIG. 23A is a representative perspective view of a tool interface of the mud bucket of FIG. 20A, in accordance with certain embodiments. FIG. 23B is a representative side view of the tool interface of the mud bucket of FIG. 20A, in accordance with certain embodiments. The tool interface 130 can be mounted to the support structure 126 above the outlet 152 and include a shield 138 that reduces debris and fluids from entering the coupling between the tool interface and the conveyance (e.g., a drill floor robot). The shield 138 also shields the outlet 152 from receiving debris and fluids during operation. The shield may not prevent ingress of debris or fluids into the storage tank through the outlet 152, but it should minimize it.

Figure 24B:
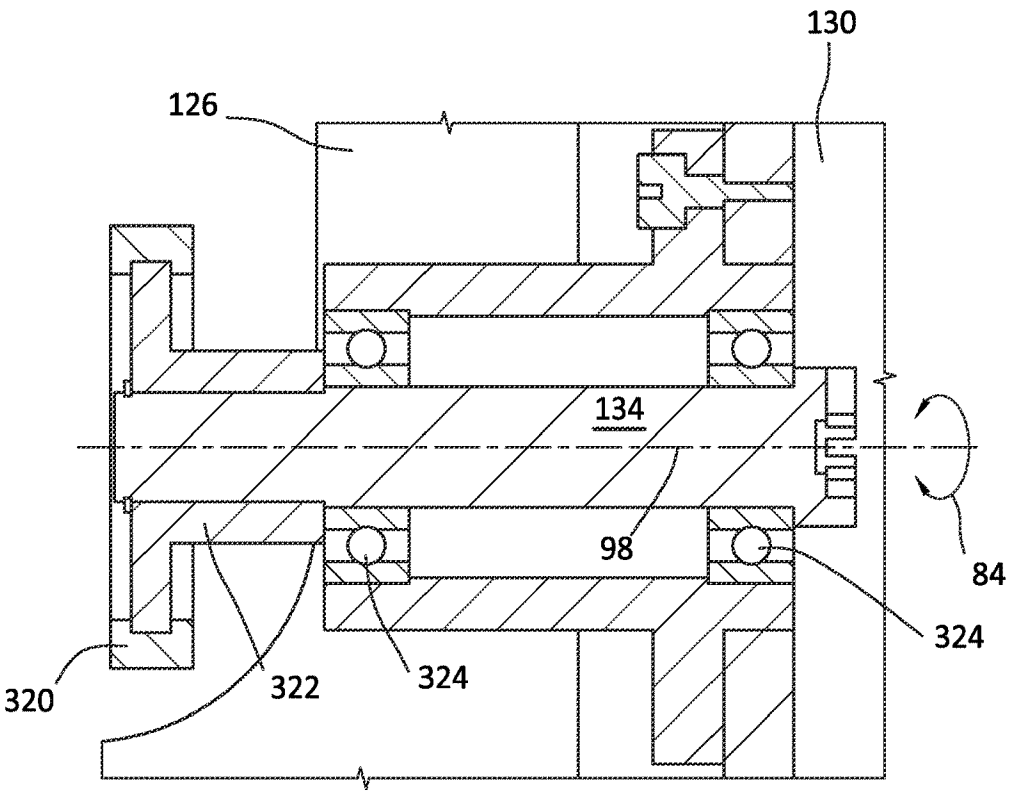
FIG. 24B is a representative detailed partial cross-sectional side view of a drive gear of the tool interface of FIG. 24A, in accordance with certain embodiments.
Figure 24A:
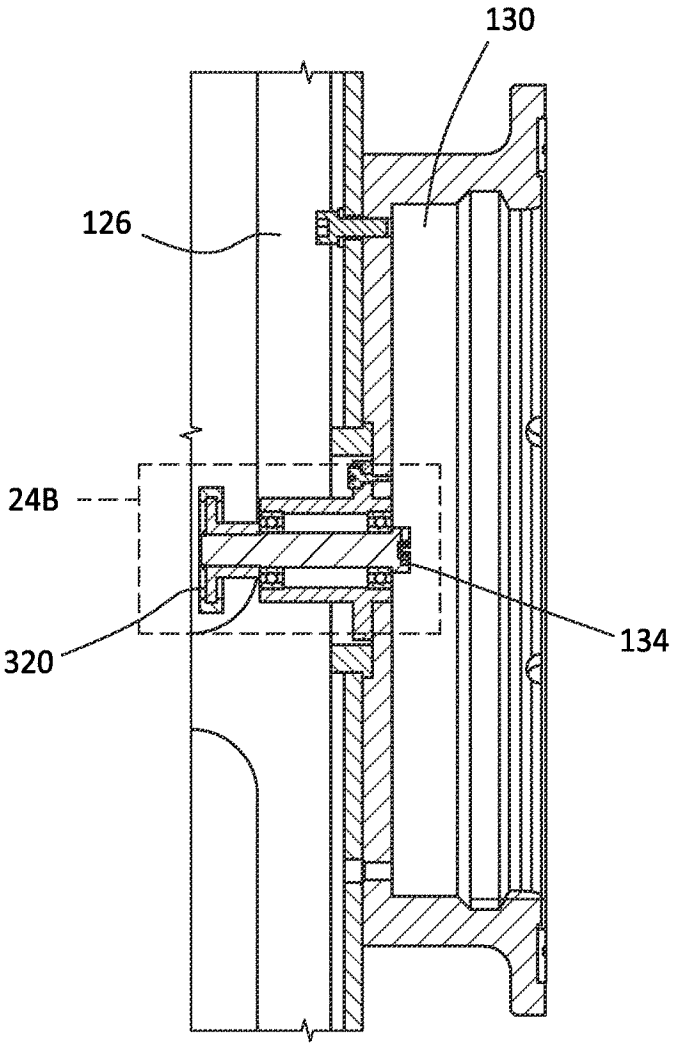
FIG. 24A is a representative partial cross-sectional side view of the tool interface of the mud bucket of FIG. 20A, in accordance with certain embodiments.

FIG. 24A is a representative partial cross-sectional side view of the tool interface 130 of the mud bucket 100 of FIG. 20A, in accordance with certain embodiments. FIG. 24B is a representative detailed partial cross-sectional side view of a drive of the tool interface of FIG. 24A, in accordance with certain embodiments. The tool interface 130 in FIGS. 24A, 24B includes only one drive gear 134 that can receive rotational forces from a robotic arm or a mobile cart. The drive gear 134 can rotate (arrows 84) about a center axis 98 and transfer the rotation via a shaft of the drive gear 134 to a drive gear 322 on an opposite side of the tool interface 130. The shaft of the drive gear 134 can be rotationally mounted in the tool interface 130 via bearings 324. The drive gear 322 can be coupled to a drive chain 320 that can transfer the rotational force to the actuator 124.

Figure 25:
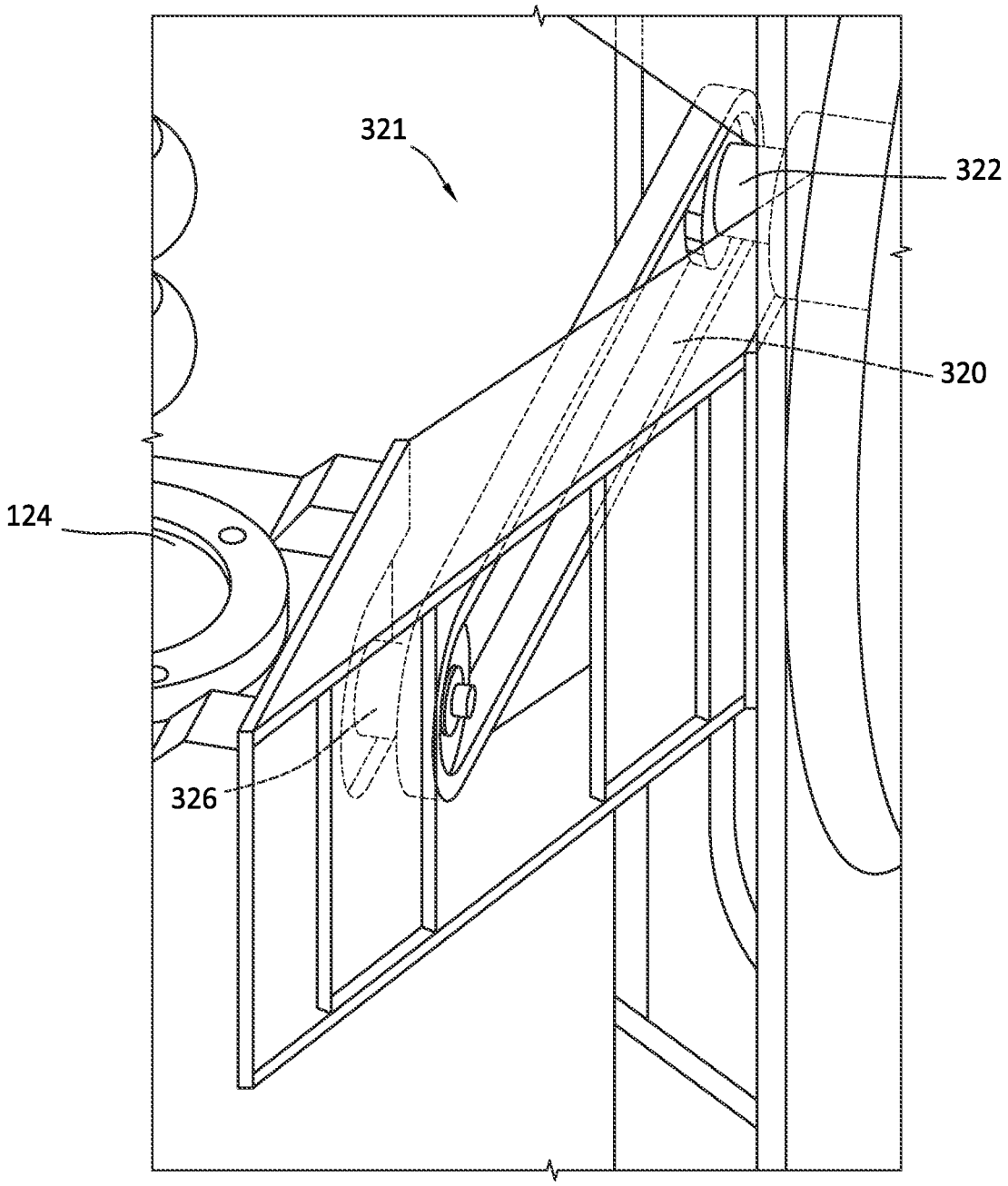
FIGS. 25, 26 are representative perspective rear views of a drive train for the clam shell enclosure of FIG. 20A, in accordance with certain embodiments.
Figure 26:
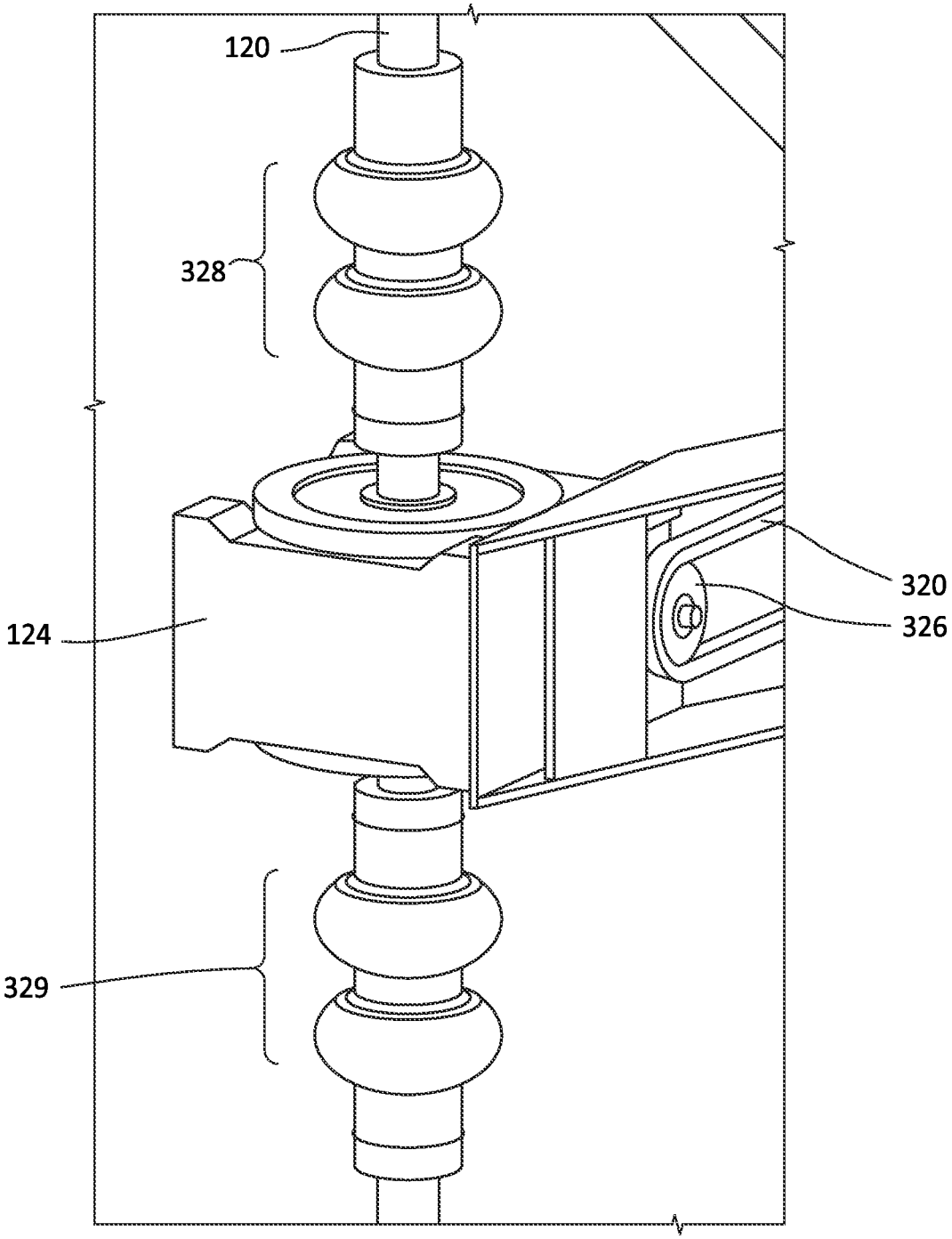

FIGS. 25, 26 are representative perspective rear views of a drive train 321 for the clam shell enclosure 110 of FIG. 20A, in accordance with certain embodiments. The drive train 321 can include a drive chain 320 that is coupled to the drive gear 322 at one end and coupled to a drive gear 326 at the other end. The drive gear 326 transfers the rotational force from the drive chain to the actuator 124 which converts the rotational forces from the drive gear 326 to rotation of the drive shaft 120. The drive shaft 120 can extend from top and bottom of the actuator 124 to the respective linkage assemblies 111. The top portion of the drive shaft 120 can include a cardan joint 328 that allows for misalignments between the actuator 124 and the top linkage assembly 111. The cardan joint 328 can be protected by a rubber bellow that encloses the joint. The bottom portion of the drive shaft 120 can include a cardan joint 329 that allows for misalignments between the actuator 124 and the bottom linkage assembly 111. The cardan joint 329 can also be protected by a rubber bellow that encloses the joint.

Figure 27B:
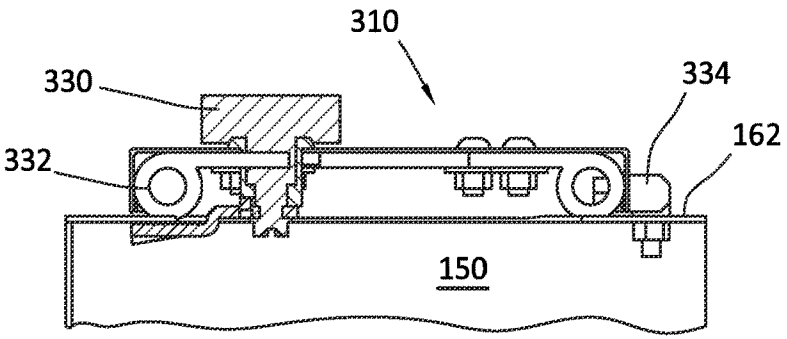
FIG. 27B is a representative partial cross-sectional view of an access door for the storage tank of FIG. 27A, in accordance with certain embodiments.
Figure 27A:
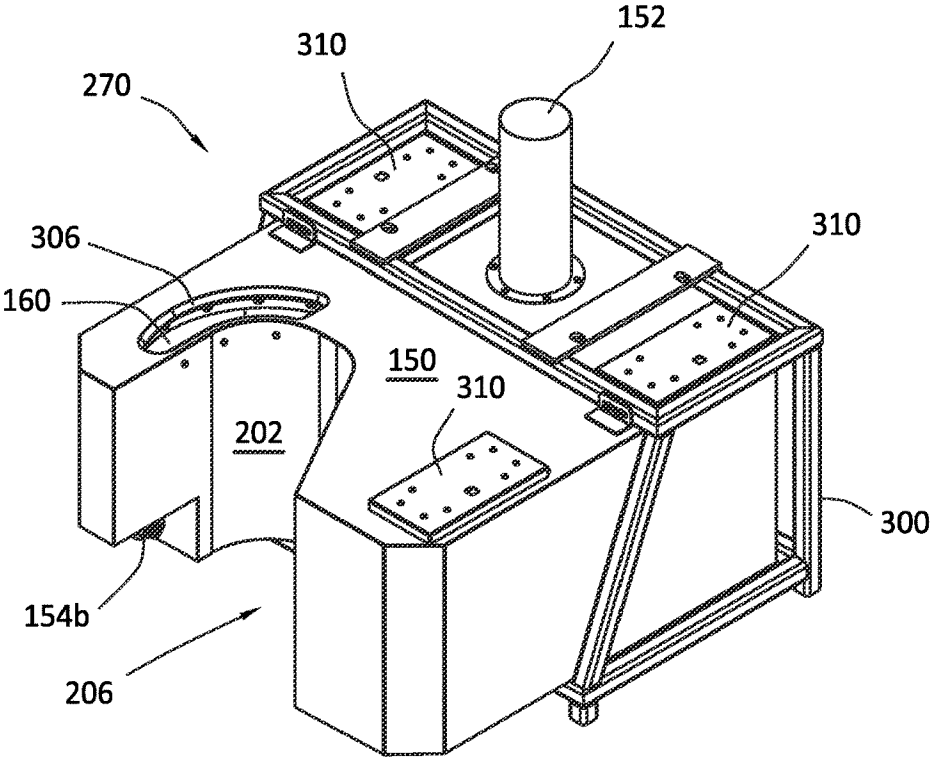
FIG. 27A is a representative perspective view of a storage tank for the mud bucket of FIG. 20A, in accordance with certain embodiments.

FIG. 27A is a representative perspective view of a storage tank assembly 270 for the mud bucket 100 of FIG. 20A, in accordance with certain embodiments. The storage tank 150 is removably installed in the support frame 300. The storage tank 150 can include the emergency outlet 154*b*, the entrance 206 to the recess (or cavity) 202, the outlet 152 from the top surface 162, the opening 160 with the seal 306 disposed along the perimeter of the opening 160, and access doors 310 for access to internal chambers of the storage tank 150.

FIG. 27B is a representative partial cross-sectional side view of an access door for the storage tank of FIG. 27A, in accordance with certain embodiments. Each access door 310 can include a hinge 334 that is attached to the top surface 162 of the storage tank 150. When the access door 310 is closed, it covers and seals an opening in the surface 162 of the storage tank 150. A seal 332 positioned around the underside perimeter of the access door 310 engages the top surface 162 when in the closed position. The latch 330 can be rotated to latch the access door closed as shown in FIG. 27B or rotated to release the access door 310 to rotate about the hinge 334 to an open position.

Figure 28B:
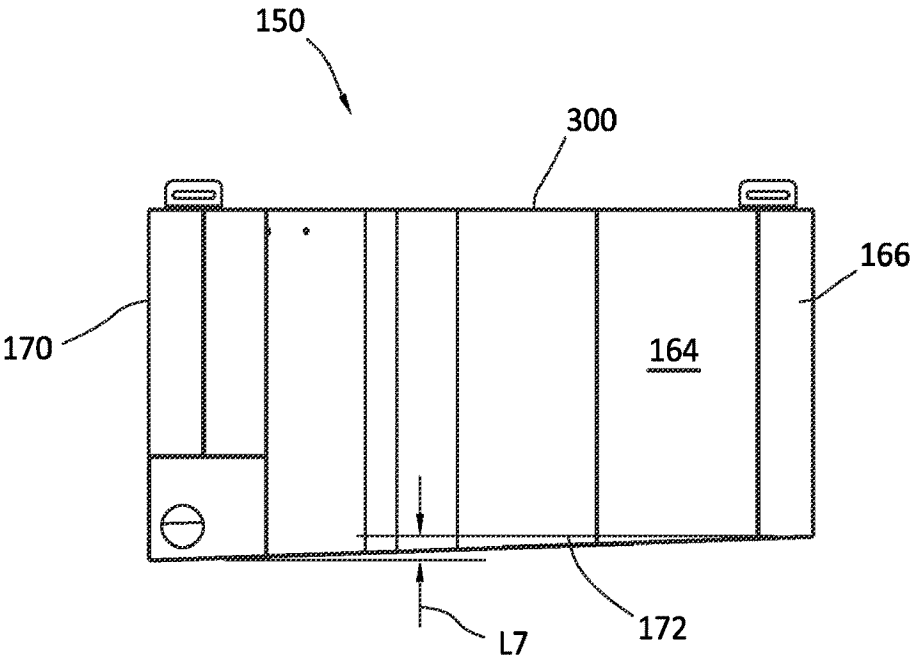
FIG. 28B is a representative front view of the storage tank in FIG. 27A, in accordance with certain embodiments.
Figure 28A:
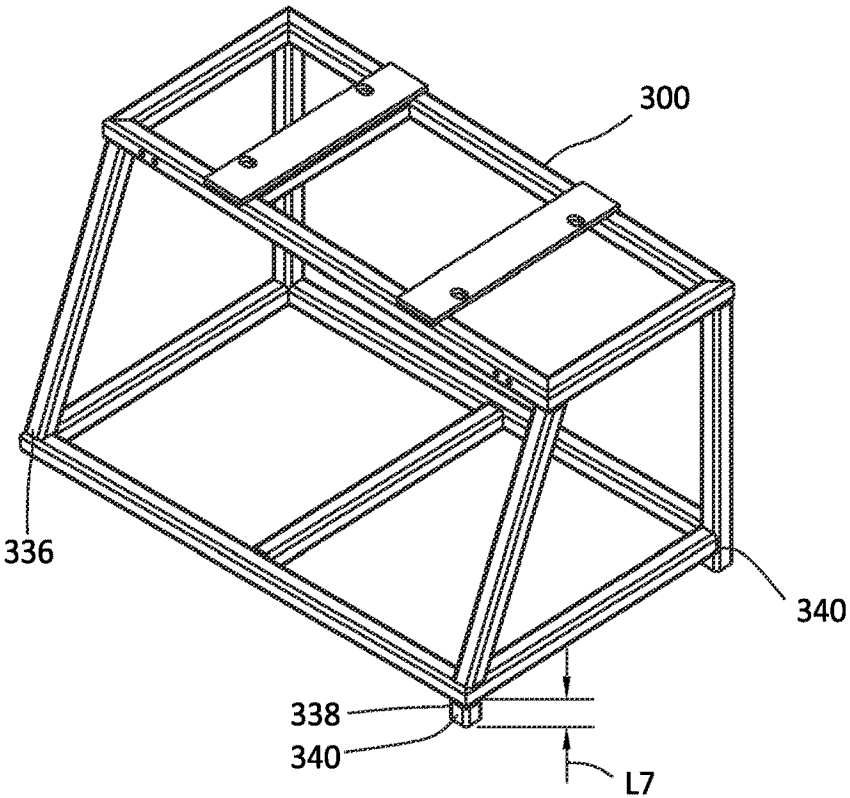
FIG. 28A is a representative perspective view of a support frame for the storage tank of FIG. 27A, in accordance with certain embodiments.

FIG. 28A is a representative perspective view of a support frame 300 for the storage tank 150 of FIG. 27A, in accordance with certain embodiments. The support frame 300 accommodates a sloped bottom surface of the storage tank 150 by having legs 340 that extend a distance of L7 below the right horizontal support on the right side 338 of the support frame 300. The left side 336 of the support frame 300 does not have an extended leg. This creates a downward slope from the right side 338 to the left side 336 at the angle of the bottom of the storage tank 150.

FIG. 28B is a representative front view of the storage tank 150 in FIG. 27A, in accordance with certain embodiments. The bottom surface 172 of the storage tank 150 can slope down from the right side 166 to the left side 170 a total vertical distance L7 which substantially equals the total vertical distance of the slope of the support frame 300. The sloped bottom surface 172 allows for faster draining of the fluid from the storage tank 150.

Figure 29B:
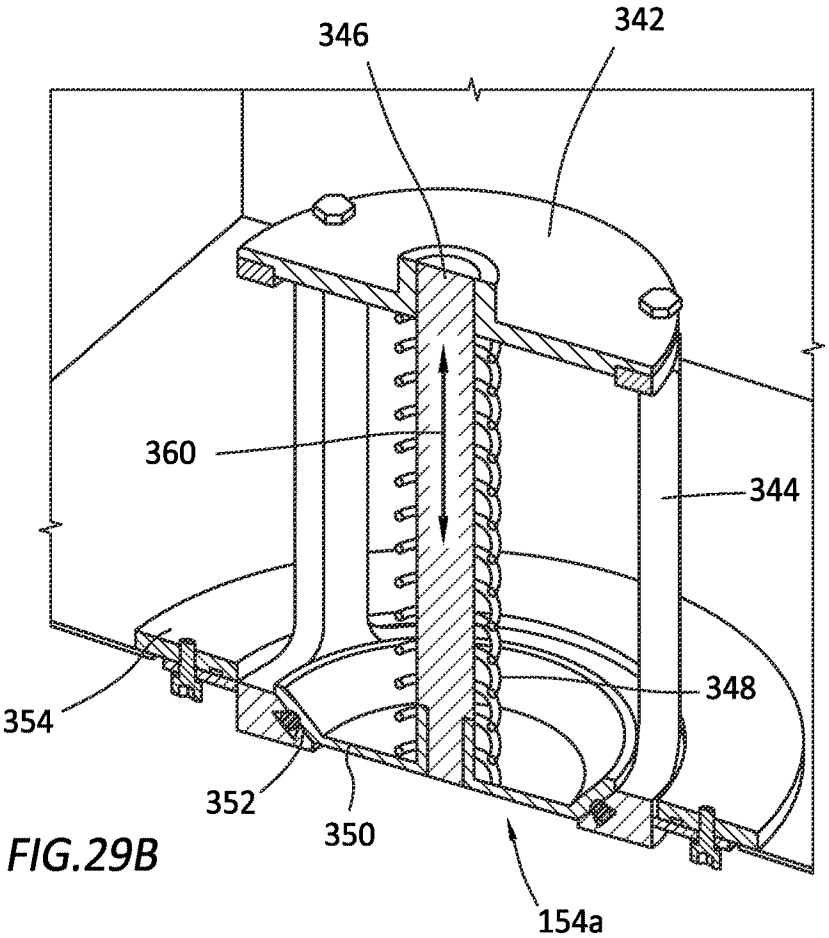
FIG. 29B is a representative partial cross-sectional view of a primary outlet with a valve for the storage tank of FIG. 29A, in accordance with certain embodiments.
Figure 29A:
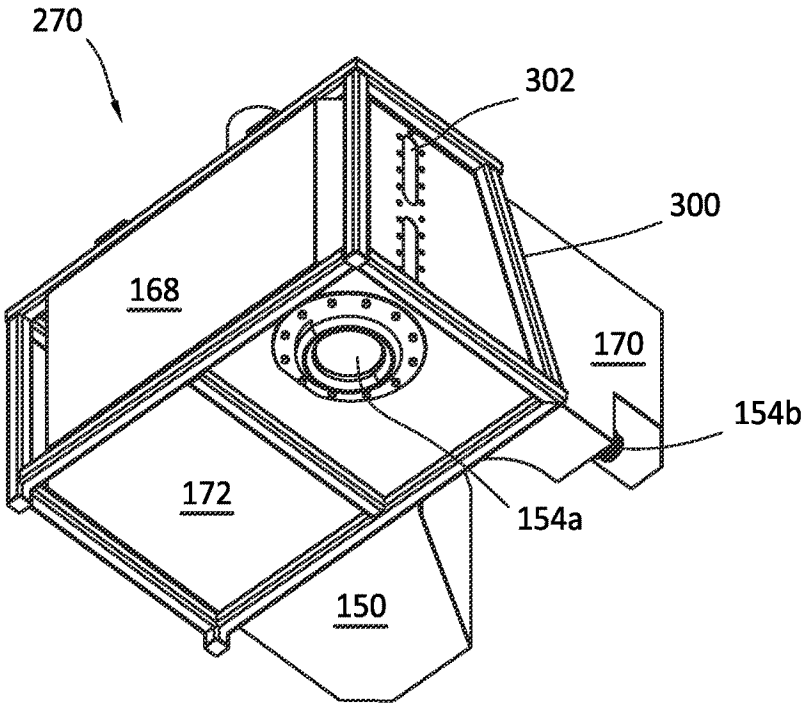
FIG. 29A is a representative perspective bottom view of the storage tank for the mud bucket of FIG. 20A, in accordance with certain embodiments.

FIG. 29A is a representative perspective bottom view of the storage tank assembly 270 for the mud bucket 150 of FIG. 20A, in accordance with certain embodiments. The bottom view shows the primary outlet 154*a* through which fluid can be drained when the mud bucket 100 is positioned in the docking station 250.

FIG. 29B is a representative partial cross-sectional view of primary outlet 154*a* with a valve 350 for the storage tank 150 of FIG. 29A, in accordance with certain embodiments. The valve 350 can be actuated by a protrusion at the docking station 250 that acts to open the valve 350 and allow fluid in the storage tank 150 to be drained. The valve 350 can include a valve body 342 that can be mounted to the storage tank 150 via a flange 354. The valve body 342 can include supports 344 that allow fluid to flow through the valve 350 while guiding the valve 350 within the valve body 342. When an upward force is applied to the valve 350, the valve 350 disengages from the valve seat 352 and moves upward between the supports 344.

A guide shaft 346 can extend through the top of the valve body 342 to guide the valve 350 up and down (arrows 360). A biasing device 348 can be used to urge the valve 350 to a closed position (i.e., valve 350 engaged with valve seat 352). Therefore, as an upward force is applied to the valve 350, the valve 350 will move upward within the supports 344 and extend the guide shaft 346 upward through the top of the valve body 342. The biasing device 348 will compress as the valve 350 moves upward. The fluid contained within the storage tank 150 can flow through the valve 350 and out of the storage tank 150 through the outlet 154*a*. When the upward force is removed from the valve 350, the biasing device 348 will urge the valve 350 back into engagement with the valve seat 352, thereby closing the valve 350.

VARIOUS EMBODIMENTS

Embodiment 1

A system for conducting a subterranean operation, the system comprising:

a mud bucket comprising:

a clam shell enclosure comprising a first portion and a second portion, with the second portion rotationally coupled to the first portion, wherein the first portion and the second portion are configured to form a sealed chamber around a joint of a tubular string at a well center of a rig when the second portion is rotated into engagement with the first portion, wherein the sealed chamber is configured to receive expelled fluid from the tubular string when the joint is unthreaded; and a storage tank that is configured to receive and store the expelled fluid from the sealed chamber while the mud bucket is located at the well center.

Embodiment 2

The system of embodiment 1, wherein the storage tank is configured to drain the expelled fluid from the storage tank when the mud bucket is moved away from the well center.

Embodiment 3

The system of embodiment 2, wherein the mud bucket is configured to drain the expelled fluid at a docking station that is positioned away from the well center.

Embodiment 4

The system of embodiment 2, wherein the storage tank comprises:

an outlet that is configured to drain the expelled fluid from the storage tank, and a valve coupled to the outlet, wherein the valve selectively permits and prevents drainage of the expelled fluid from the storage tank.

Embodiment 5

The system of embodiment 4, wherein the mud bucket is configured to drain the expelled fluid at a docking station that is positioned away from the well center, and wherein the docking station operates the valve to an open position when the mud bucket is engaged with the docking station.

Embodiment 6

The system of embodiment 5, wherein the docking station comprises a fluid inlet to a collection chamber and a one-way valve coupled to the fluid inlet that allows the expelled fluid to be drained into the collection chamber and prevents flow of a collection fluid from the collection chamber, through the one-way valve, and out of the fluid inlet.

Embodiment 7

The system of embodiment 1, wherein the storage tank holds the expelled fluid as the mud bucket is moved away from the tubular string.

Embodiment 8

The system of embodiment 1, wherein a conveyance manipulates the mud bucket about a drill floor.

Embodiment 9

The system of embodiment 8, wherein the conveyance substantially aligns a longitudinal axis of the clam shell enclosure with a longitudinal axis of the tubular string.

Embodiment 10

The system of embodiment 8, wherein the conveyance comprises a robot or a manually operated cart.

Embodiment 11

The system of embodiment 10, wherein the robot comprises a drill floor robot or a robotic arm rotationally attached to the drill floor.

Embodiment 12

The system of embodiment 8, wherein the conveyance couples to the mud bucket via a tool interface on the mud bucket, and wherein the tool interface couples a rotational drive from the conveyance to the clam shell enclosure and rotates the second portion between closed, open, and partially open positions.

Embodiment 13

A method for conducting a subterranean operation, the method comprising:

sealing a mud bucket around a joint of a tubular string extending from a drill floor;

unthreading the joint;

capturing fluid expelled from the tubular string in a sealed chamber of the mud bucket as the joint is being unthreaded; and storing the fluid in a storage tank of the mud bucket.

Embodiment 14

The method of embodiment 13, further comprising:

unsealing the mud bucket from around the joint; and storing the fluid in the storage tank as the mud bucket is conveyed away from the tubular string.

Embodiment 15

The method of embodiment 14, further comprising:

conveying the mud bucket to a docking station on the drill floor;

engaging the mud bucket with the docking station; and discharging the fluid from the storage tank into the docking station.

Embodiment 16

The method of embodiment 15, further comprising repeating the preceding operations for each desired joint of the tubular string as the tubular string is tripped out of a wellbore.

Embodiment 17

The method of embodiment 13, wherein the mud bucket further comprises a clam shell enclosure comprising a first portion and a second portion, with the second portion rotationally coupled to the first portion between open, closed, and partially open positions.

Embodiment 18

The method of embodiment 17, further comprising:

aligning the clam shell enclosure with the tubular string;

rotating the second portion into engagement with the first portion, thereby forming the sealed chamber around the joint;

flowing the fluid from the sealed chamber into the storage tank; and storing the fluid in the storage tank as the clam shell enclosure is opened by rotating the second portion out of engagement with the first portion.

Embodiment 19

The method of embodiment 18, further comprising:

conveying the mud bucket to a docking station on the drill floor;

engaging the mud bucket with the docking station; and discharging the fluid from the storage tank into the docking station.

Embodiment 20

The method of embodiment 19, wherein engaging the mud bucket with the docking station actuates a valve of the mud bucket that releases the fluid into the docking station.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A system for conducting a subterranean operation, the system comprising:

a mud bucket comprising:

a clam-shell enclosure comprising a first portion and a second portion, with the second portion rotationally coupled to the first portion, wherein the first portion and the second portion are configured to form a sealed chamber around a joint of a tubular string at a well center of a rig when the second portion is rotated into engagement with the first portion, and wherein the sealed chamber is configured to receive expelled fluid from the tubular string when the joint is unthreaded; and a storage tank that is configured to receive and store the expelled fluid from the sealed chamber while the mud bucket is located at the well center, wherein the storage tank is integral to the clam-shell enclosure, wherein the storage tank is positioned above a rig floor when the mud bucket is positioned at the well center, and wherein the expelled fluid remains in the storage tank while the mud bucket is located at the well center.

2. The system of claim 1, wherein the storage tank is configured to drain the expelled fluid from the storage tank when the mud bucket is moved away from the well center.

3. The system of claim 2, wherein the mud bucket is configured to drain the expelled fluid at a docking station that is positioned away from the well center.

4. The system of claim 1, wherein the storage tank holds the expelled fluid as the mud bucket is moved away from the tubular string.

5. The system of claim 1, wherein a conveyance manipulates the mud bucket about a drill floor.

6. The system of claim 5, wherein the conveyance substantially aligns a longitudinal axis of the clam-shell enclosure with a longitudinal axis of the tubular string.

7. The system of claim 5, wherein the conveyance comprises a robot or a manually operated cart.

8. The system of claim 7, wherein the robot comprises a drill floor robot or a robotic arm rotationally attached to the drill floor.

9. The system of claim 5, wherein the conveyance couples to the mud bucket via a tool interface on the mud bucket, and wherein the tool interface couples a rotational drive from the conveyance to the clam-shell enclosure and rotates the second portion between closed, open, and partially open positions.

10. A system for conducting a subterranean operation, the system comprising:

a mud bucket comprising:

a clam-shell enclosure comprising a first portion and a second portion, with the second portion rotationally coupled to the first portion, wherein the first portion and the second portion are configured to form a sealed chamber around a joint of a tubular string at a well center of a rig when the second portion is rotated into engagement with the first portion, and wherein the sealed chamber is configured to receive expelled fluid from the tubular string when the joint is unthreaded; and a storage tank that is configured to receive and store the expelled fluid from the sealed chamber while the mud bucket is located at the well center, wherein the storage tank is configured to drain the expelled fluid from the storage tank when the mud bucket is moved away from the well center, wherein the storage tank comprises:

an outlet that is configured to drain the expelled fluid from the storage tank, and a valve coupled to the outlet, wherein the valve selectively permits and prevents drainage of the expelled fluid from the storage tank.

11. The system of claim 10, wherein the mud bucket is configured to drain the expelled fluid at a docking station that is positioned away from the well center, and wherein the docking station operates the valve to an open position when the mud bucket is engaged with the docking station.

12. The system of claim 11, wherein the docking station comprises a fluid inlet to a collection chamber and a one-way valve coupled to the fluid inlet that allows the expelled fluid to be drained into the collection chamber and prevents flow of a collection fluid from the collection chamber, through the one-way valve, and out of the fluid inlet.

13. A method for conducting a subterranean operation, the method comprising:

sealing a mud bucket around a joint of a tubular string extending from a drill floor;

unthreading the joint;

capturing fluid expelled from the tubular string in a sealed chamber of the mud bucket as the joint is being unthreaded; and storing the fluid in a storage tank of the mud bucket, wherein the storage tank is integral to a clam-shell enclosure of the mud bucket, wherein the storage tank is positioned above a rig floor when the mud bucket is positioned at a well center, and wherein the expelled fluid remains in the storage tank while the mud bucket is located at the well center.

14. The method of claim 13, further comprising:

unsealing the mud bucket from around the joint; and storing the fluid in the storage tank as the mud bucket is conveyed away from the tubular string.

15. The method of claim 14, further comprising:

conveying the mud bucket to a docking station on the drill floor;

engaging the mud bucket with the docking station; and discharging the fluid from the storage tank into the docking station.

16. The method of claim 15, further comprising repeating the preceding operations for each desired joint of the tubular string as the tubular string is tripped out of a wellbore.

17. The method of claim 13, wherein the mud bucket further comprises a clam-shell enclosure comprising a first portion and a second portion, with the second portion rotationally coupled to the first portion between open, closed, and partially open positions.

18. The method of claim 17, further comprising:

aligning the clam-shell enclosure with the tubular string;

rotating the second portion into engagement with the first portion, thereby forming the sealed chamber around the joint;

flowing the fluid from the sealed chamber into the storage tank; and storing the fluid in the storage tank as the clam-shell enclosure is opened by rotating the second portion out of engagement with the first portion.

19. The method of claim 18, further comprising:

conveying the mud bucket to a docking station on the drill floor;

engaging the mud bucket with the docking station; and discharging the fluid from the storage tank into the docking station.

20. The method of claim 19, wherein engaging the mud bucket with the docking station actuates a valve of the mud bucket that releases the fluid into the docking station.

* * * * *